US007937914B2

(12) United States Patent
Savicki et al.

(10) Patent No.: US 7,937,914 B2
(45) Date of Patent: May 10, 2011

(54) DEVICE AND METHOD FOR EVACUATING STORAGE BAG

(75) Inventors: Alan F. Savicki, Yorkville, IL (US); Scott Binger, Bridgeview, IL (US)

(73) Assignee: The Glad Products Company, Oakland, CA (US)

( * ) Notice: Subject to any disclaimer, the term of this patent is extended or adjusted under 35 U.S.C. 154(b) by 0 days.

(21) Appl. No.: 12/409,008

(22) Filed: Mar. 23, 2009

(65) Prior Publication Data

US 2009/0173038 A1 Jul. 9, 2009

Related U.S. Application Data

(60) Division of application No. 11/736,401, filed on Apr. 17, 2007, now abandoned, which is a continuation-in-part of application No. PCT/US2006/019818, filed on May 22, 2006.

(51) Int. Cl.
*B65B 31/04* (2006.01)

(52) U.S. Cl. ..... 53/510; 53/79; 53/405; 53/434; 53/512; 99/472; 141/65

(58) Field of Classification Search ..... 53/434, 53/512, 79, 432, 510, 85, 403, 405; 99/472; 141/65

See application file for complete search history.

(56) References Cited

U.S. PATENT DOCUMENTS

| | | | | |
|---|---|---|---|---|
| 4,367,565 | A * | 1/1983 | Parise | 15/321 |
| 4,984,611 | A * | 1/1991 | Takatsuki et al. | 141/65 |
| 5,546,997 | A * | 8/1996 | Miramon | 141/65 |
| 5,765,608 | A * | 6/1998 | Kristen | 141/198 |
| 6,520,071 | B1 * | 2/2003 | Lanza | 99/472 |
| 6,644,489 | B2 * | 11/2003 | Chang | 220/203.01 |
| 2005/0039421 | A1 * | 2/2005 | Cheung | 53/510 |
| 2005/0074342 | A1 * | 4/2005 | Lemme et al. | 417/415 |

* cited by examiner

*Primary Examiner* — Thanh K Truong
(74) *Attorney, Agent, or Firm* — David Peterson

(57) ABSTRACT

To enhance evacuation of a storage bag having a one-way valve element and to reduce noise during evacuation, a hand-held evacuation device includes one or more gaskets that can be made of resilient material. A gasket can be disposed about the rim of an inlet opening of the evacuation device to provide both a leak-free interface between the evacuation device and the storage bag and to reduce vibration and chatter of the evacuation device against a rigid support surface. A gasket can also be provided intermediately between a main body portion of the evacuation device and a nozzle portion that is to be placed adjacent to the storage bag during use. The intermediate gasket isolates vibrations in the main body portion thereby reducing vibrations and chatter of the evacuation device against a rigid support surface.

6 Claims, 22 Drawing Sheets

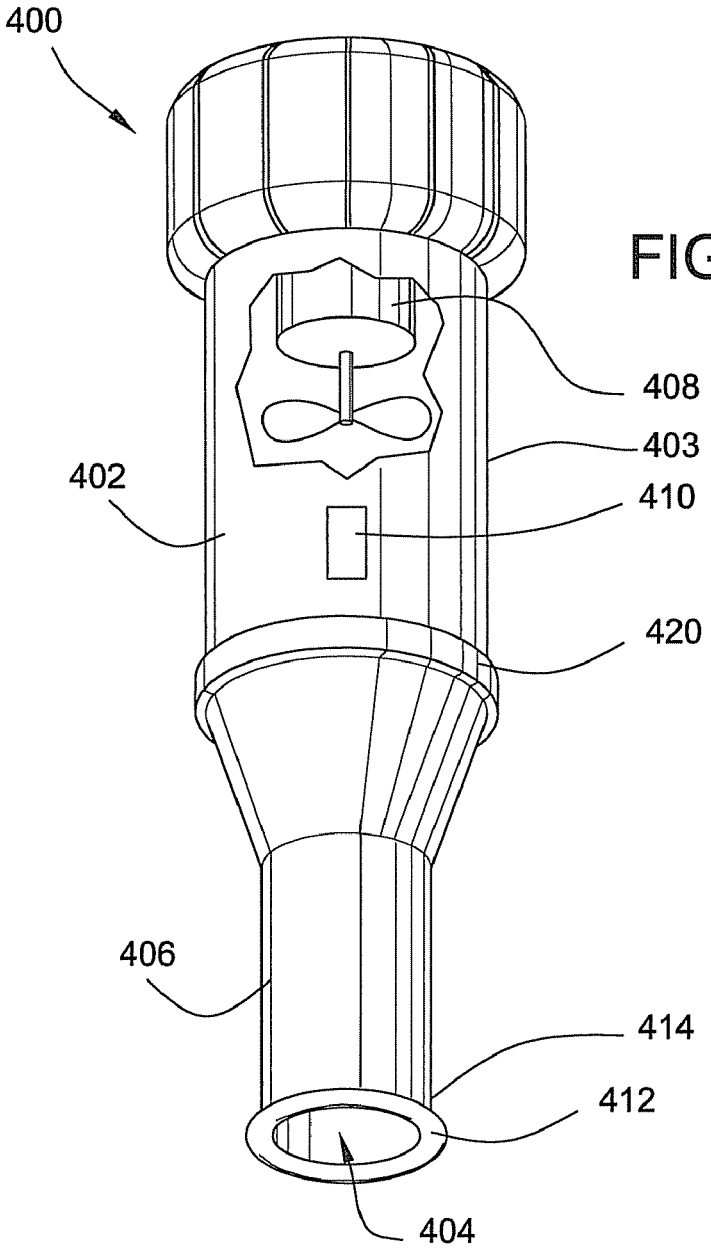
FIG. 7
FIG. 8
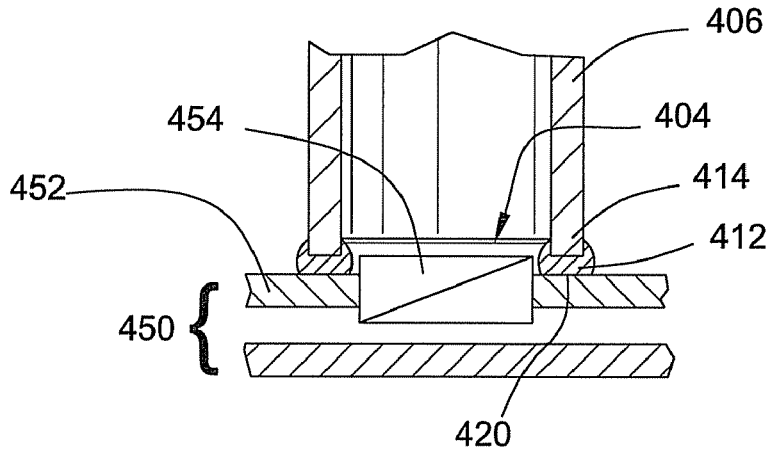

FIG. 20
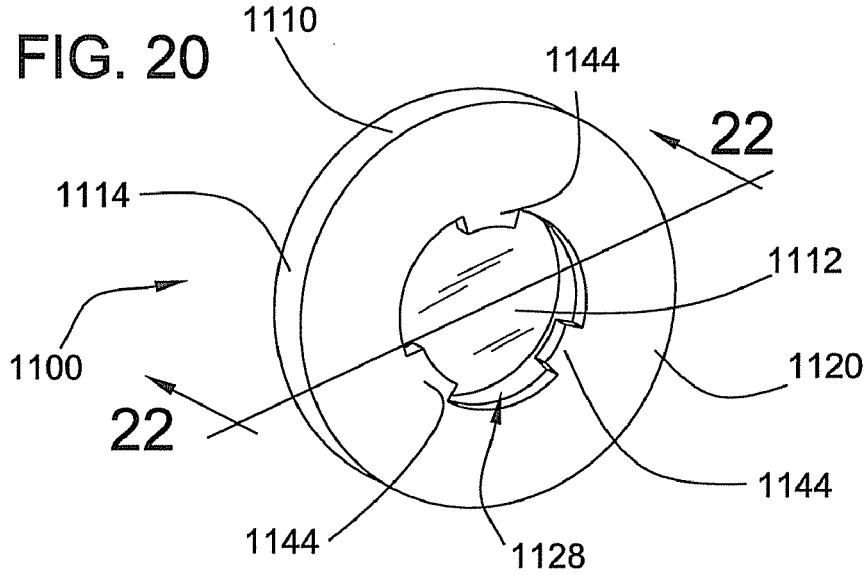
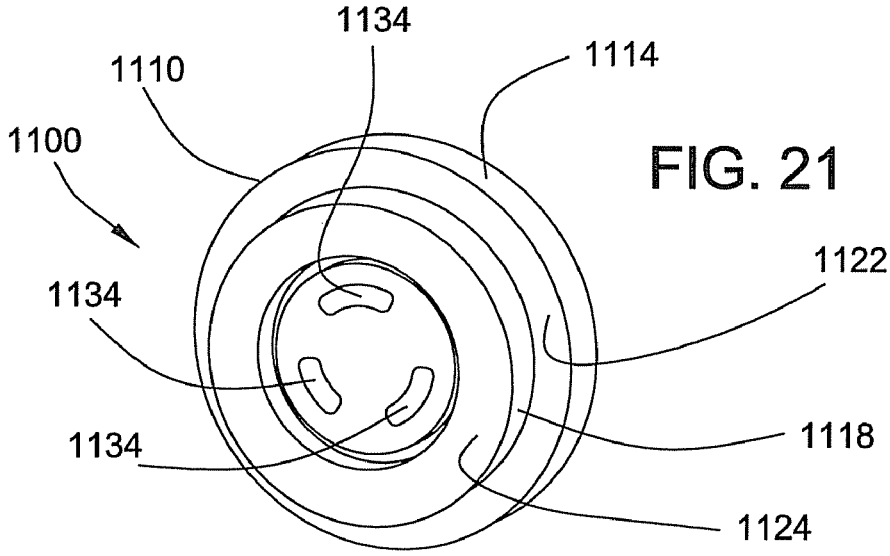
FIG. 21
FIG. 22
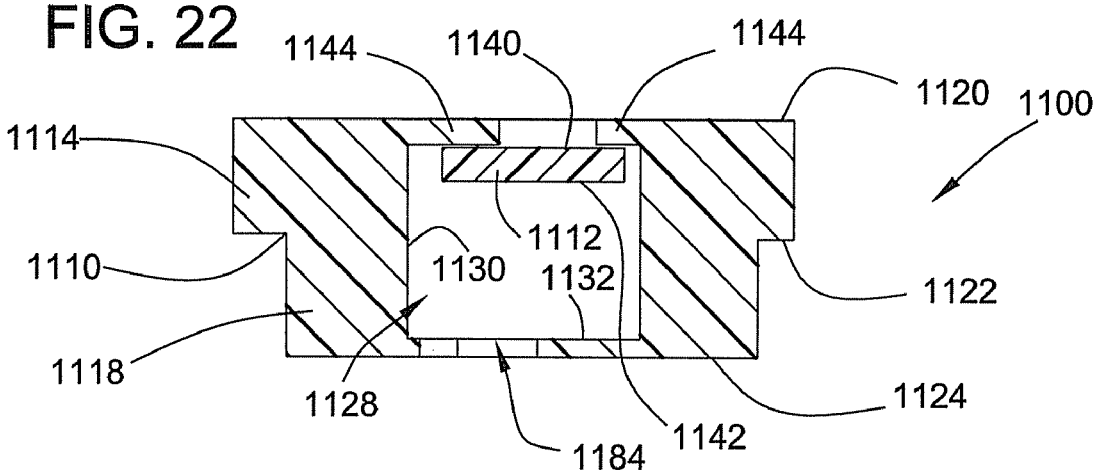

DEVICE AND METHOD FOR EVACUATING STORAGE BAG

RELATED APPLICATIONS

This application is a divisional of U.S. application Ser. No. 11/736,401, filed Apr. 17, 2007 now abandoned, which is a continuation-in-part of International Application No. PCT/US06/19818, filed May 22, 2006, which claims the benefit of U.S. Provisional Application No. 60/685,462, filed May 27, 2005 which is incorporated by reference in its entirety.

BACKGROUND

Storage bags are commonly used for a variety of purposes such as storing food items. Such storage bags are typically made from a flexible, thermoplastic web material that is configured to provide an interior volume into which food items can be inserted. To preserve the inserted food, the storage bag may also include a distinct closing mechanism, such as interlocking fastening strips, for sealing closed an opening through which the interior volume is accessible.

One problem that occurs with the aforementioned storage bags is that latent air may remain trapped within the interior volume after sealing closed the opening. The trapped air may cause spoiling or dehydration of the food items. To remove the trapped air, it is known to provide a one-way valve element or other evacuation device communicating with the interior volume. The one-way valve element allows for the evacuation of trapped air while preventing the ingress of air from the surrounding volume into the interior volume. One known method of evacuating air through the valve element is to lay the storage bag on a horizontal surface and place the nozzle of an evacuation device against the bag so as to surround the valve element. When activated, the evacuation device draws air from the interior volume through the valve element.

The flexible material of the sidewall presents certain problems when evacuating storage bags in the foregoing manner. One problem that may arise is that the flexible sidewall may distort and displace under applied pressure from the evacuation device nozzle which may make the formation of a vacuum tight seal between the nozzle and the storage bag difficult and thereby inhibits evacuation. Also due in part to the flexibility of the sidewall material, the storage bag is often laid horizontally on a surface such as a table top for support during evacuation. When laid horizontally, the contents of the bag may shift towards the valve element where they can be drawn through the valve element and into the evacuation device.

Another problem that can arise with evacuating storage bags in the foregoing manner is that often the evacuation device will vibrate as an inherent result of its operation. When the nozzle of the evacuation device is placed adjacent the bag and pressed against a hard or rigid surface during evacuation, the vibration can be transmitted to the rigid surface thereby resulting in undesirable noise.

BRIEF SUMMARY

A device and method to simplify and improve upon the evacuation of storage bags which utilize one-way valve elements. In one embodiment, a comparatively rigid bracket is provided to support the flexible storage bag during evacuation. The bracket has two generally parallel, spaced-apart panels that provide a gap therebetween into which the flexible storage bag can be inserted. An aperture is disposed through one of the panels to permit access to the one-way valve element. To evacuate the bag, a nozzle of an evacuation device is inserted through the aperture and pressed adjacent the bag sidewall about the valve element. Because the aperture helps align the nozzle with the valve element, an improved seal is realized. Additionally, the first and second panels of the bracket may provide a clamping effect that helps prevent the storage bag from being drawn into the nozzle during evacuation. Another advantage is that the bracket allows the storage bag to be held vertically so that the contents fall under gravity to the bottom of the bag and away from the valve element.

In another embodiment, the nozzle of the evacuation device is pressed adjacent to the first panel about the aperture. Because the nozzle is interfaced against the comparatively rigid bracket rather than the flexible storage bag, an improved seal is realized. Additionally, the bracket and aperture may also help ensure that the nozzle and valve element align correctly.

In another embodiment, a device is provided for evacuating a storage bag which has a one-way valve element. The evacuation device may also include a housing that encloses an electrically powered airflow generating unit. The airflow generating unit communicates with an inlet opening disposed into the housing that is adapted to be placed about the one-way valve element attached to a storage bag. To improve the airtight seal that must be established between the evacuation device and the storage bag during evacuation, the evacuation device includes a gasket attached about the rim of the inlet opening. Another advantage of attaching the gasket about the rim is that the gasket can be made of an elastic or resilient material that can provide a vibration dampening effect when the rim of the evacuation device is placed against the rigid bracket or, if no bracket is used, against the rigid countertop. In another embodiment, a main body of the housing and the nozzle of the evacuation device can be formed as separate components and the vibration dampening gasket can be located therebetween.

In yet another aspect, the evacuation device itself can include a bracket having parallel, spaced apart first and second panels that provide a gap therebetween. The flexible storage bag can be aligned with the inlet opening in the aforementioned manner. In some embodiments, the gasket can be included as part of the combination evacuation-bracket device.

One advantage of the evacuation device is the improved seal provided by the gasket. Another advantage of the gasket, either attached about the rim or located between the nozzle and the housing, is that the vibration dampening effect of the gasket reduces noise that otherwise may result from the evacuation device vibrating against a rigid support surface. These and other advantages and features will become apparent from the detailed description and the accompanying drawings.

BRIEF DESCRIPTION OF THE DRAWINGS

FIG. 7 is a perspective view of a hand-held evacuation device that includes a housing with an inlet opening and a gasket attached about the rim of the inlet opening.

FIG. 8 is a cross-sectional view showing the inlet opening and gasket of the evacuation device interfacing with a flexible storage bag having a one-way valve element.

FIG. 20 is a front perspective view of an embodiment of a one-way valve element for use with flexible bags.

FIG. 21 is a rear perspective view of the one-way valve element of FIG. 20.

FIG. 22 is a cross-sectional view through the one-way valve element, as taken along line 22-22 of FIG. 20.

DETAILED DESCRIPTION OF THE EMBODIMENTS

Figure 1:
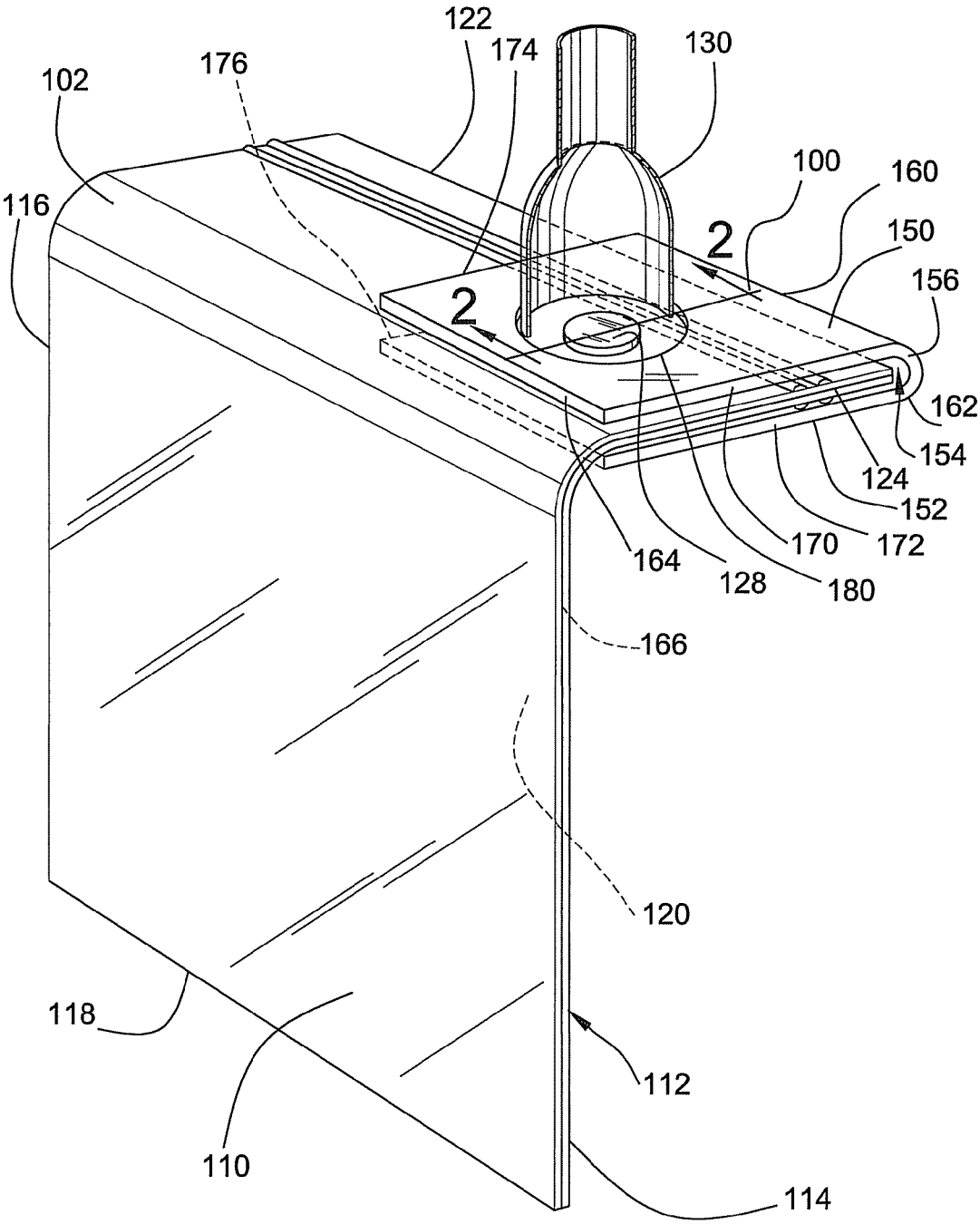
FIG. 1 is a perspective view of a support bracket receiving a flexible storage bag that has a one-way valve element, and a nozzle of a vacuum device, shown in breakaway, inserted through an aperture in the bracket to interface with the storage bag.

Now referring to the drawings, wherein like reference numbers refer to like elements, there is illustrated in FIG. 1 a support bracket 100 that is placed about a flexible storage bag 102. Storage bags 102 of the type intended for use with the inventive support bracket 100 are typically made from first and second sidewalls 110, 112 of flexible thermoplastic web material that are joined together along first and second side edges 114, 116 and a closed bottom edge 118 to provide an interior volume 120. To access the interior volume 120, an opening 122 is provided by leaving the top edges of the first and second sidewalls 110, 112 unconnected. To temporarily seal the opening 122 when desired, the storage bag 102 includes interlocking fastener strips 124.

As will be appreciated, once the opening 122 is sealed closed, latent air may remain trapped in the interior volume 120 of the storage bag 102. The latent air can cause food items stored in the internal volume to spoil and adds undesirable bulk to the bag. To remove the trapped air, the storage bag 102 may be supplied with a one-way valve element 128 attached to the first flexible sidewall 110 that communicates with the interior volume 120. Air can be exhausted from the interior volume by, for example, placing the nozzle 130 of an evacuation device about the one-way valve element 128 and activating the device to draw air through the valve element.

Figure 3:
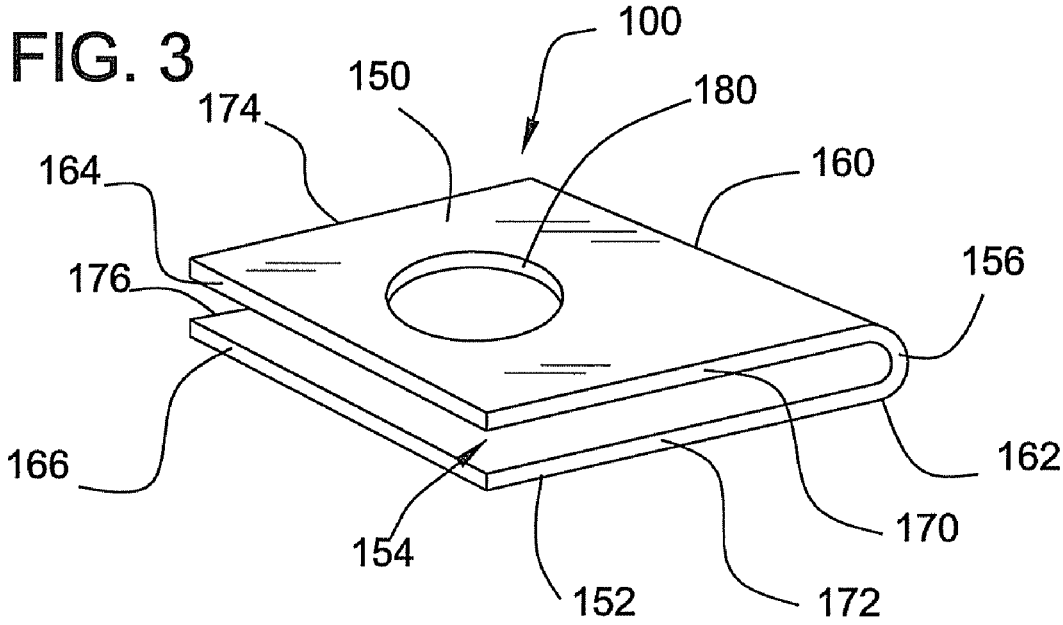
FIG. 3 is a top perspective view of the bracket having first and second panels and showing an aperture disposed in a first panel.
Figure 4:
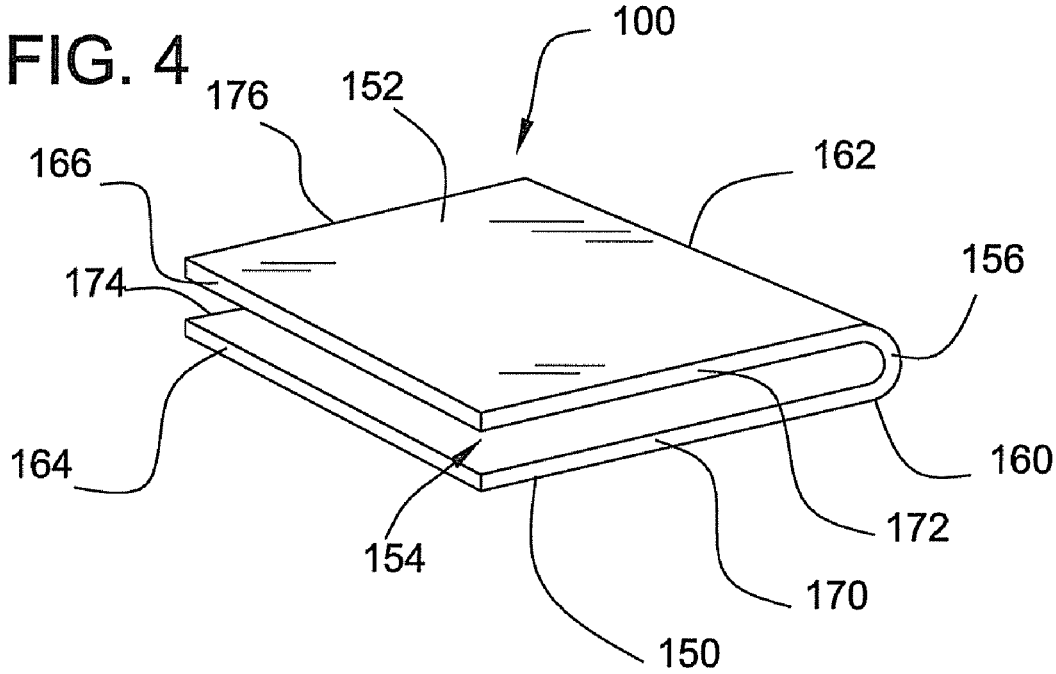
FIG. 4 is a bottom perspective view of the bracket.

To facilitate evacuation of air from the storage bag 102, the bag can be inserted into the inventive support bracket 100. Referring to FIGS. 1, 3, and 4, the bracket 100 includes a first panel 150 and a generally identical second panel 152. The first and second panels 150, 152 are flat, planar structures and, though they can have any suitable shape, in the illustrated embodiment, the panels are rectangular each with a first longer edge 160, 162 and parallel second longer edge 164, 166 and each with a first shorter edge 170, 172 and a parallel second shorter edge 174, 176. The panels 150, 152 are arranged parallel to and spaced apart from each other to provide a gap 154 for receiving the flexible storage bag 102. The interior and exterior surfaces of the panels 150, 152 can have a smooth finish. To connect the spaced-apart panels 150, 152 together, a U-shaped portion 156 extends along the corresponding first longer edges 160, 162. The bracket 100 can be made from any suitable material including, for example a comparably rigid thermoplastic.

Figure 2:
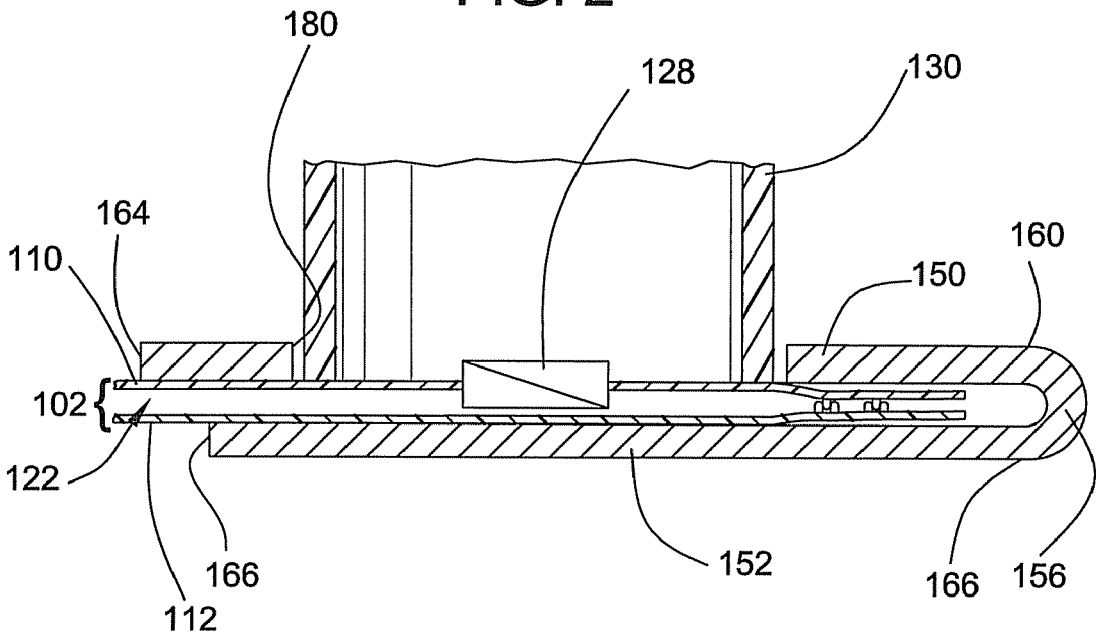
FIG. 2 is a cross-sectional view of the bracket, flexible storage bag, and nozzle taken along line 2-2 of FIG. 1.

To provide access to the one-way valve element 128 when the storage bag 102 has been inserted between the first and second panels 150, 152, an aperture 180 is disposed through the first panel 150. The aperture 180 can have any suitable shape including, as illustrated, circular. Referring to FIGS. 1 and 2, the aperture 180 can be placed a predetermined distance from the first longer edges 160, 162 that corresponds to the distance with which the valve element 128 is spaced from the opened top edge 122 of the storage bag 102. Furthermore, the aperture 180 can be spaced the same distance from the first shorter side edges 170, 172 as the valve element 128 is spaced from the first side edge 114 of the bag 100. Accordingly, when the storage bag 100 is inserted between the first and second panels 150, 152 such that the opened top edge 122 abuts against the U-shaped portion 156 and the first side edge 112 lines up with the first shorter edges 170, 172, the valve element 128 aligns with the aperture 162.

To evacuate the storage bag 102, the nozzle 130 is inserted through the aperture 180 in the first panel 150 and pressed adjacent the first sidewall 110 of the storage bag 102. Where the valve element 128 has been properly aligned with the aperture 180, the nozzle 130 will extend about the valve element. To enable the nozzle 130 to fit through the circular aperture 130 and extend about the valve element 128, in the illustrated embodiment, the nozzle 130 may also be circular and have a diameter less than that of the aperture. In this embodiment, the nozzle 130 has a diameter which is greater than that of the valve element. In other embodiments, the nozzle may contact the valve element and may be approximately the same size as the valve element when inserted through the aperture. When the vacuum device attached to the nozzle 130 is activated, the generated suction force will draw the portion of the first sidewall 110 exposed through the aperture 180 adjacent to the rim of the nozzle, thereby providing an air tight sealing interface between the nozzle and valve element 128. Because the rest of the storage bag 102 is constrained within the bracket 100, further suction draws latent air from the interior volume 120 through the one-way valve element 128.

To facilitate evacuation of the storage bag 100, the aperture 180 can help align the nozzle 130 with the valve element 128. Furthermore, because the storage bag 102 is held between the first and second panels 150, 152 and only exposed to the evacuation device via the aperture 180, the bracket 100 restrains the bag from being drawn into the nozzle during evacuation. As is apparent from FIG. 1, the bracket 100 also allows the bag 102 to be held vertically during evacuation with the top portion and valve element 128 folded to the side. Hence, the contents of the bag 100 will fall to the bottom edge 118 due to gravity and are less likely to be drawn into the valve element 128 and nozzle during evacuation.

Figure 5:
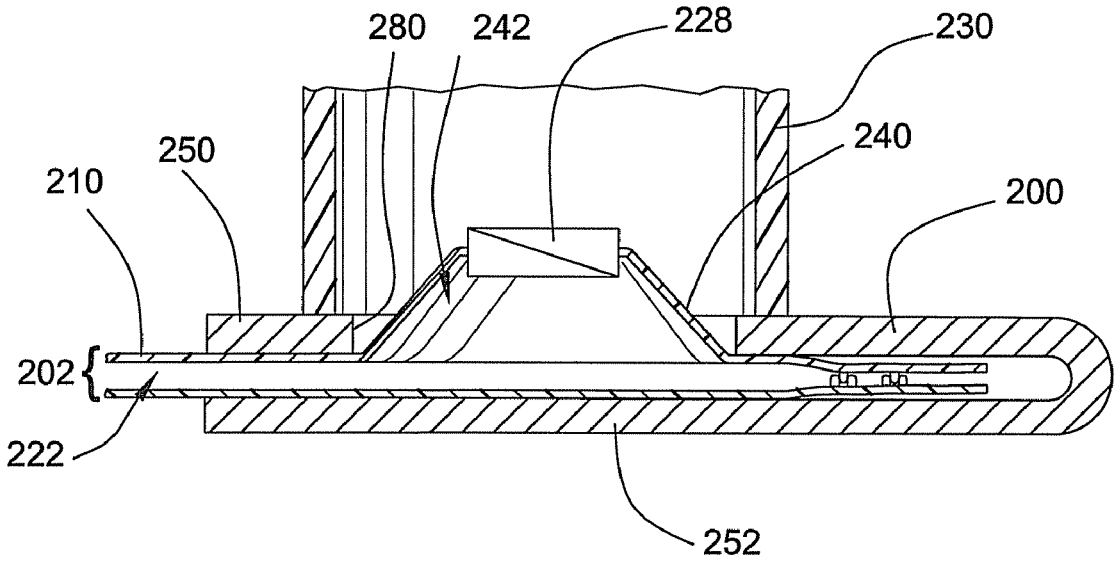
FIG. 5 is a cross-sectional view of a support bracket, a flexible storage bag, and a nozzle of an evacuation device, similar to FIG. 2, wherein the nozzle interfaces directly with the bracket and the flexible storage bag includes an expandable separator to which a one-way valve element is attached.

Illustrated in FIG. 5 is another manner of using a bracket 200 of the foregoing type to evacuate a storage bag 202. Instead of being inserted through the aperture as described above, the nozzle 230 connected to the evacuation device is pressed against the first panel 250 about the aperture 280. To fit around the circular aperture 280, in the illustrated embodiment, the nozzle 230 should also be circular and have a diameter larger than that of the aperture. Because the bracket 200 is rigid and the exterior surface of the first panel 250 is smooth, the nozzle 230 can make an airtight sealing interface about the aperture 280 above the valve element 228. Once the evacuation device is activated, as will be appreciated from FIG. 5, the suction in the nozzle 230 draws the first sidewall 210 adjacent the interior surface of the first panel 250 thereby blocking any flow of environmental air into the nozzle. Further suction draws latent air from the interior volume 222 through the valve element 228 to evacuate the storage bag 202. Hence, the bracket 200 helps support the flexible storage bag 202 during evacuation and provides a rigid support surface against which the nozzle 230 can be pressed.

In FIG. 5, the bracket 200 is illustrated in use with a storage bag 202 having a fluid separator 240 such as those described in U.S. patent application Ser. No. 11/166,574 (GLAD 492.552A, LVM 232187) and U.S. patent application Ser. No. 10/880,784 (GLAD 492.464, LVM 228536), both of which are incorporated by reference in their entirety. Storage bags 202 described in these applications have a fluid separator 240 formed in or attached to the first sidewall 210 that can expand under the influence of a vacuum source to provide a chamber 242 spacing the valve element 228 away from the second sidewall 212. The chamber 242 provided by the separator 240 functions to separate out fluids and juices entrained in the exhausting air. In the illustrated embodiment, so that the aperture 280 allows and assists the separator 240 in expanding into its expanded shape, the aperture can correspond in size and shape to the separator. Hence, the separator 240 can expand through and be outlined by the aperture 280.

Figure 6:
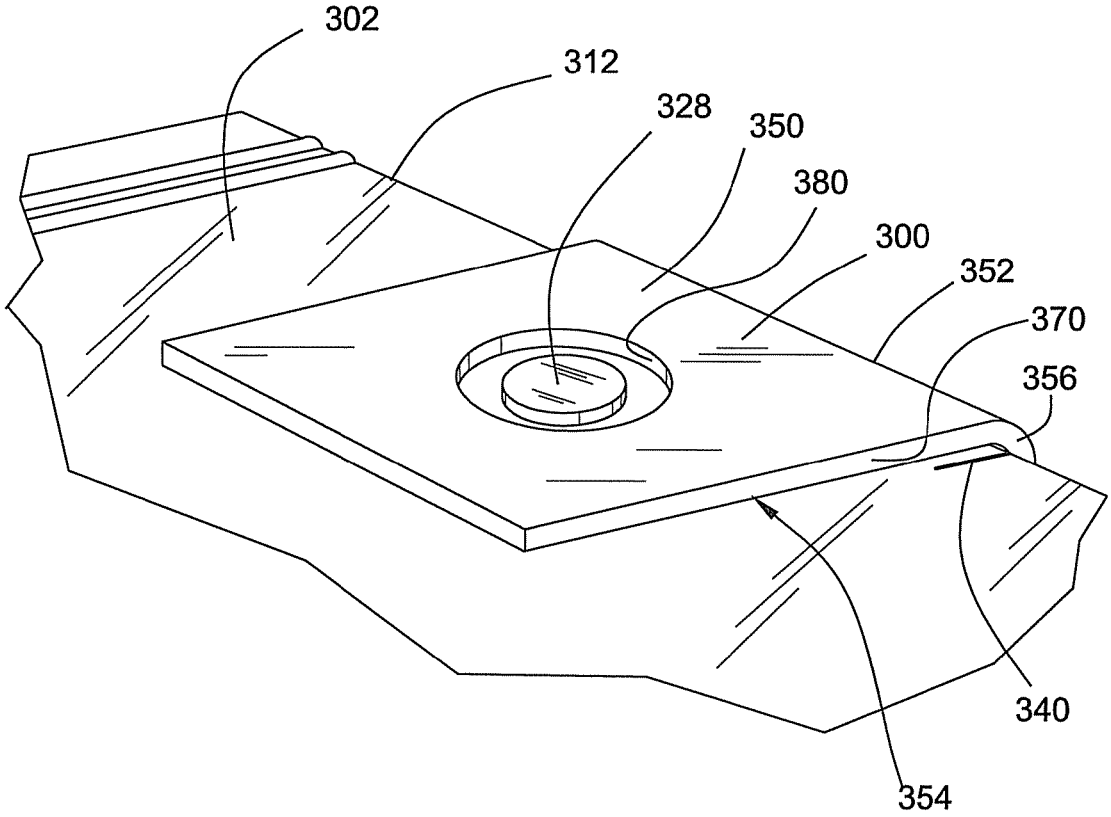
FIG. 6 is a perspective view of the support bracket receiving a flexible storage bag that has a one-way valve element and indicia for aligning the support bracket.

Illustrated in FIG. 6 is bracket 300 of the above-described design receiving a storage bag 302 having a one-way valve element 328. To facilitate aligning the valve element 328 with an aperture 380 disposed through the first panel 350 of the bracket 300, the distance the valve element is spaced-apart from an edge 312 of the storage bag 302 dimensionally corresponds with the distance that the aperture is spaced-apart from the U-shaped portion 356. Additionally, the storage bag 302 includes indicia 340 printed or otherwise marked along the edge 312. Hence, when the storage bag 302 is inserted into the gap 354 such that the edge 312 abuts the U-shaped portion 356 and a first shorter edge 370 of the first panel 350 lines up with the indicia 340, the valve element 328 aligns with and is exposed at aperture 380.

Referring to FIG. 7, there is illustrated an embodiment of a handheld evacuation device 400 for evacuating a storage bag. The illustrated evacuation device 400 includes an elongated housing 402 that can be made from rigid thermoplastic material and may include a main body portion 403 and a tapered nozzle portion 406. The nozzle portion 406 is generally cylindrical and situated in-line with the rest of the housing 402, though in other embodiments the nozzle portion and housing could have other shapes and configurations. At one end of the nozzle there is an air inlet opening 404 adapted to engage the one-way valve element on a storage bag.

The main body portion 403 of the housing 402 encloses an airflow generating unit 408 which communicates via the nozzle 406 with the air inlet opening 404. The illustrated airflow generating unit 408 includes an electrically powered motor that drives a fan blade or propeller which can move air from the vicinity of the nozzle 406 and inlet opening 404 thereby creating a vacuum. The air flow generating unit 408 can be selectively activated by a switch 410 exposed on the exterior of the housing 402. It will be appreciated that in other embodiments the airflow generating device 408 can take other forms such as, for instance, a hand operated pump. To evacuate a storage bag 450 using the evacuation device 400, referring to FIG. 8, the nozzle portion 406 can be pressed directly against the sidewall 452 of the bag 450 so that the inlet opening 404 surrounds a one-way valve element 454 attached to the sidewall. Of course, it will be readily appreciated that in other embodiments, evacuation device 400 can be used with a support bracket such as the type described above.

Figure 27:
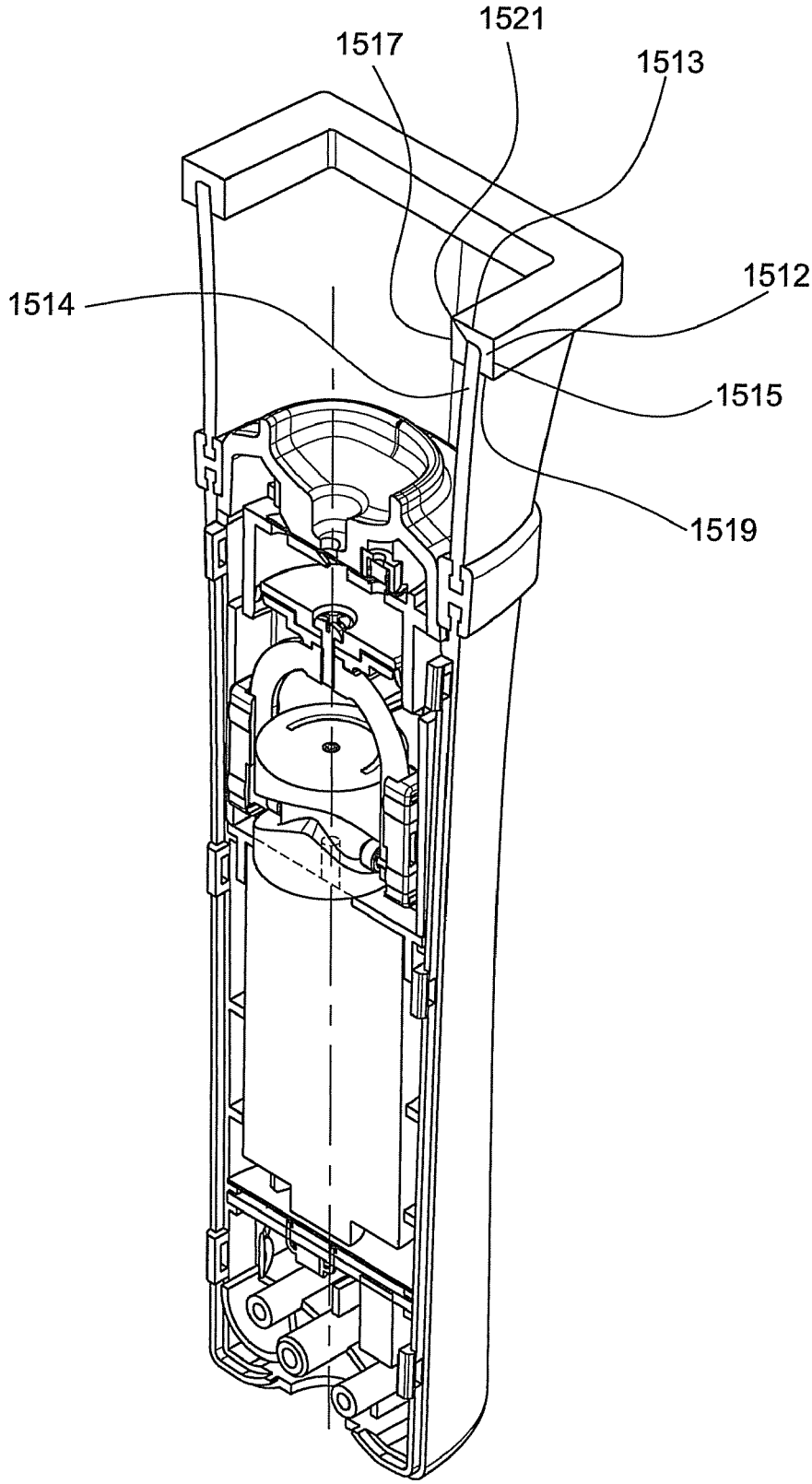
FIG. 27 is a cross-sectional view of another embodiment of an evacuation device with another embodiment of a gasket.

To enhance the sealing interface between the storage bag 450 and the evacuation device 400 and to reduce noise during operation, in various embodiments the evacuation device can include a gasket 412 attached about the rim 414 of the inlet opening 404. In the illustrated embodiment, where the nozzle 406 and inlet opening 404 are circular, the gasket 412 will have an annular shape. The gasket 412 can be made from any suitable material such as, for example, resilient foam, an elastomeric material, or rubber. Advantageously, these materials typically have a vibration dampening effect that can dissipate vibrations throughout the evacuation device which result from operation of the airflow generating unit. Moreover, as illustrated in FIG. 6, the gasket can have a circular cross-section and can be fashioned as an o-ring attached to the rim 414. When the gasket 412 is pressed against the sidewall 452 of the bag 450, the gasket deforms to provide a leak-free interface. Additionally, the vibration dampening effect of the resilient gasket can prevent chatter, rattling, or other noises from developing when the nozzle of an operating evacuation device is placed against the rigid bracket or a countertop. In other words, the gasket can act like a cushion that prevents direct contact between the rigid nozzle and a rigid support surface. It will be appreciated that, in the embodiments in which the gasket 412 is resilient and has a circular cross-section, pressing the evacuation device 400 further against the sidewall 452 causes further deformation of the gasket. Thus, a larger surface area 420 of the gasket 412 contacts the sidewall 452, thereby improving the sealing effect. Furthermore, the gasket 412 can be impregnated with oil or other material to improve its sealing effect against the sidewall 452. In another embodiment, the gasket may have other cross-sections, such as, rectangular, square or oval. For example, referring to FIG. 27, the gasket 1512 has a rectangular cross-section. The gasket 1512 may have a flat upper surface 1513, flat side surfaces 1515, 1517, and a flat bottom surface 1519. The bottom surface 1519 may include a groove 1521 to engage the rim 1514. These gasket cross-sections may be used with any of the embodiments discussed herein as appropriate.

In a further embodiment of the handheld evacuation device of FIG. 7, the main body 403 and the nozzle 404 can be formed as separate, distinct parts. To connect the two parts together, an intermediate gasket 420 can be provided between and connected to both the main body 403 and the nozzle 404. The intermediate gasket 420 can take the form of a tubular sleeve. The gasket can be made from a resilient foam, an elastomeric material or rubber. Accordingly, the airflow generating unit 408 can still communicate with the inlet opening 404 via the intermediate gasket 420. Like the gasket about the rim, the intermediate gasket 420 can be made from any suitable material such as, for example, resilient foam or an elastomeric material which preferably has a vibration dampening effect. The intermediate gasket 420 can thereby prevent transfer of vibrations resulting from operation of the airflow generating unit 408 by isolating those vibrations in the main body 403. Hence, noises resulting from chatter or rattling of the nozzle against a rigid support surface are reduced or prevented.

The bag 450 and the evacuation device 400 of FIGS. 7 and 8 can be provided and distributed together as a system so that an end user can store and preserve food items in the foregoing manner. In addition, the brackets 100, 200 of FIGS. 1-4 may also be distributed with the bag, the evacuation device, or both. Moreover, the evacuation device 400 of FIG. 7 can be provided with either only the gasket about the rim, only the intermediate gasket between the nozzle and the main body, both or neither.

Figure 9:
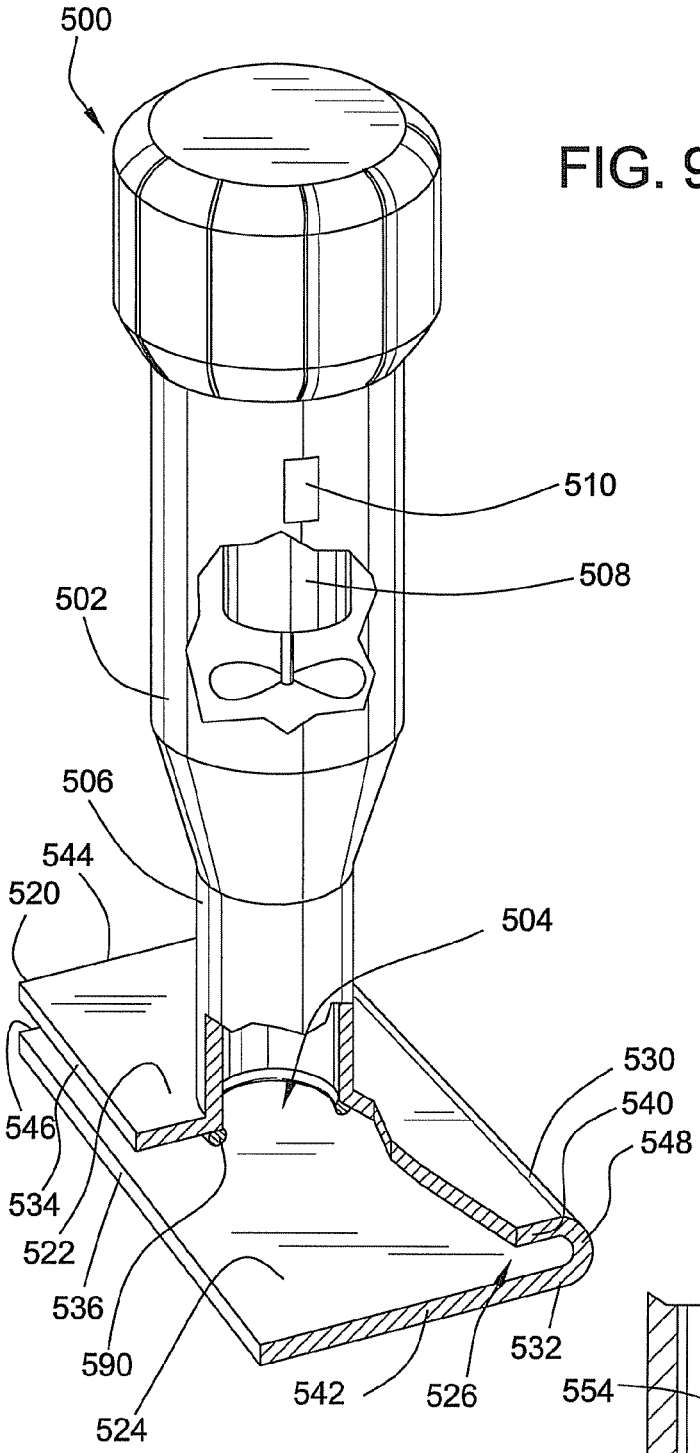
FIG. 9 is a perspective view of another embodiment of a hand-held evacuation device that includes a housing with an inlet opening and a support bracket joined about the inlet opening.

Illustrated in FIG. 9 is another embodiment of a handheld evacuation 500 device for removing latent air from a storage bag via a one-way valve element. The evacuation device 500 also has an elongated housing 502 that can be made from thermoplastic material. The housing 502 has an inlet opening 504 at one end of a nozzle portion 506. To actually enable evacuation, the housing 502 encloses an airflow generating unit 508 that communicates with the inlet opening 504. The airflow generating unit 508 includes an electrical motor that drives a fan blade or propeller which can move air from the vicinity of the nozzle and inlet opening thereby creating a vacuum. The air flow generating unit can be selectively activated by a switch 510 exposed on the exterior of the housing 502. It will be appreciated that in other embodiments the airflow generating device 508 can take other forms such as, for instance, a hand operated pump.

To facilitate evacuation of flexible storage bags, the evacuation device 500 also includes an integral bracket 520 proximate the inlet opening 504. As described above, the bracket 520 has parallel first and second panels 522, 524 that are spaced apart from each other to provide a gap 526. While the first and second panels 522, 524 can have any suitable shape, in the illustrated embodiment, the panels are rectangular, each having first longer edges 530, 532 and parallel second longer edges 534, 536 and each having a first shorter edges 540, 542 and a parallel second shorter edges 544, 546. To connect the panels together, a U-shaped portion 548 extends along and is joined to the first longer edges 530, 532. As will be appreciated, the 180 degree U-shaped portion 548 holds the first and second panels 522, 524 parallel and defines the size of the gap 526.

Figure 10:
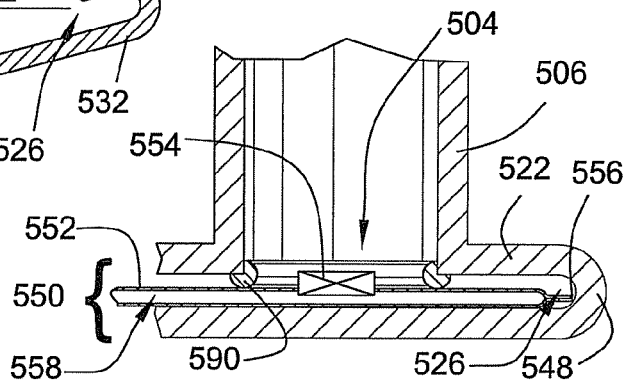
FIG. 10 is a cross-sectional view showing the inlet opening and support bracket interfacing with the flexible storage bag having a one-way valve element.

To join the bracket 520 to the rest of the evacuation device 500, the first panel 522 can be integrally formed with and is orthogonal to the nozzle portion 506. As illustrated in FIG. 10, the inlet opening 504 is disposed through the first panel 522 to interface with a one-way valve element 554 attached to a storage bag 550 that has been inserted into the gap 526. Preferably, the valve element 554 will be attached at a predetermined distance from an edge 556 of the storage bag 550 which corresponds to the distance between the U-shaped portion 548 and the inlet opening 504. Hence, when a storage bag 500 is inserted into the gap 526 such that the edge 556 abuts against the U-shaped portion 548, the valve element 554 aligns with the inlet opening 504.

Referring to FIG. 9, to enhance the leak tight interface between the storage bag 550 and the evacuation device 500, a gasket 590 can be attached about the rim of the inlet opening 504. In the illustrated embodiment where the inlet opening 504 is circular, the gasket 590 has an annular shape. The gasket 590 can be made of any suitable material including, for example, foam or an elastomeric material. The gasket 590 is disposed along the rim of the inlet opening 504 such that a portion protrudes into gap 526 between the first and second panels 522, 524. Referring to FIG. 10, when a bag 550 is inserted into the gap 526 and the evacuation device is activated, the sidewall 552 of the bag is forced against the gasket 590 thereby blocking any flow of environmental air into the nozzle 506. Further evacuation draws latent air from the interior volume 558 through the valve element 554 to evacuate the storage bag 550.

Figure 11:
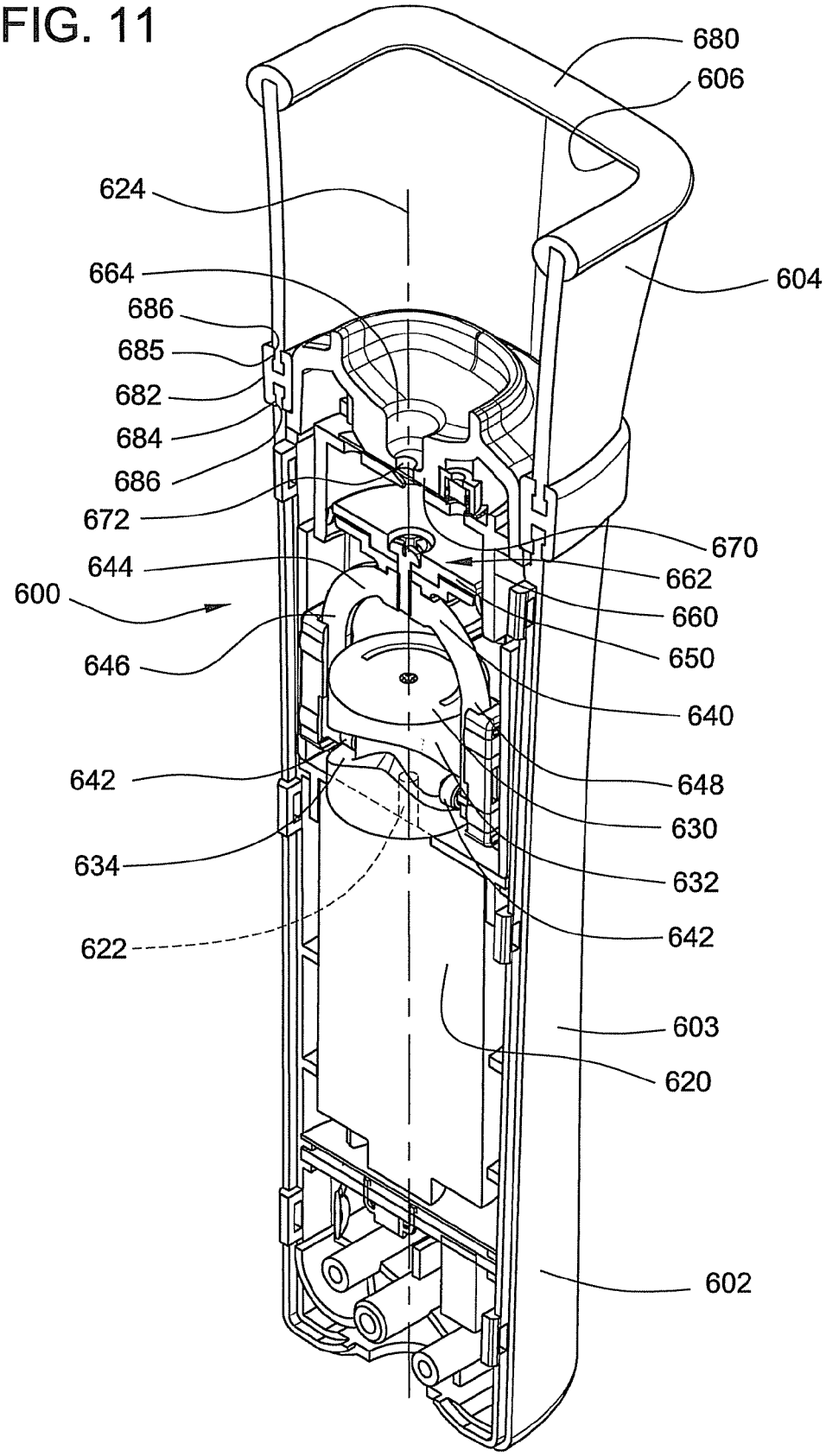
FIG. 11 is a cross-sectional perspective view of another embodiment of a hand-held evacuation device that includes an airflow generating unit having a cam and a yoke.

Referring to FIG. 11, there is illustrated another embodiment of a handheld evacuation device 600 for removing latent air from a storage bag which functions by converting rotational motion to linear motion. The evacuation device 600 includes a comparatively rigid, elongated housing 602 adapted to be gripped by the hands of a user. The forward end of the housing 602 is formed as a skirt-like nozzle 604 that provides an inlet opening 606. Enclosed in the housing 602 at the rearward end is an electrically operated motor 620 with a rotating shaft 622 that extends along an axis line 624. Mounted to the motor shaft 622 and concentric with the axis line 624 is a cylindrical cam 630. Disposed into and extending in a sinusoidinal pattern circumferentially about the cylindrical sidewall 632 of the cam 630 is a channel 634.

The evacuation device 600 also includes a yoke 640 having one or more follower elements 642 that can be received in the channel 634 of the cam 630. To locate the follower elements 642 in the channel 634, the yoke 640 has a U-shaped configuration including a forward directed common joint 644 from which extends rearward directed, bifurcated first and second arms 646, 648 to which the follower elements 642 are connected. When the device is assembled, the common joint 644 aligns with the axis line 624 and the first and second arms 646, 648 extend along opposite halves of the cylindrical cam 630 to position the follower elements 642 in the channel 634.

Forward of the cam 630, the common joint 644 of the yoke 640 is attached to a reciprocal element 650, such as a piston, that is slidably received in a cylindrical bore or chamber 662 provided by a solid chamber body 660. The chamber 662 communicates with the skirt-like nozzle 604 at the forward end of the device via an inlet aperture 664 disposed through the chamber body 660. To facilitate evacuation of air via the reciprocal element and chamber, a valve plate 670 including an inlet valve 672 is provided between the chamber 662 and the nozzle 604 such that the inlet valve aligns with the inlet aperture 664.

Figure 12:
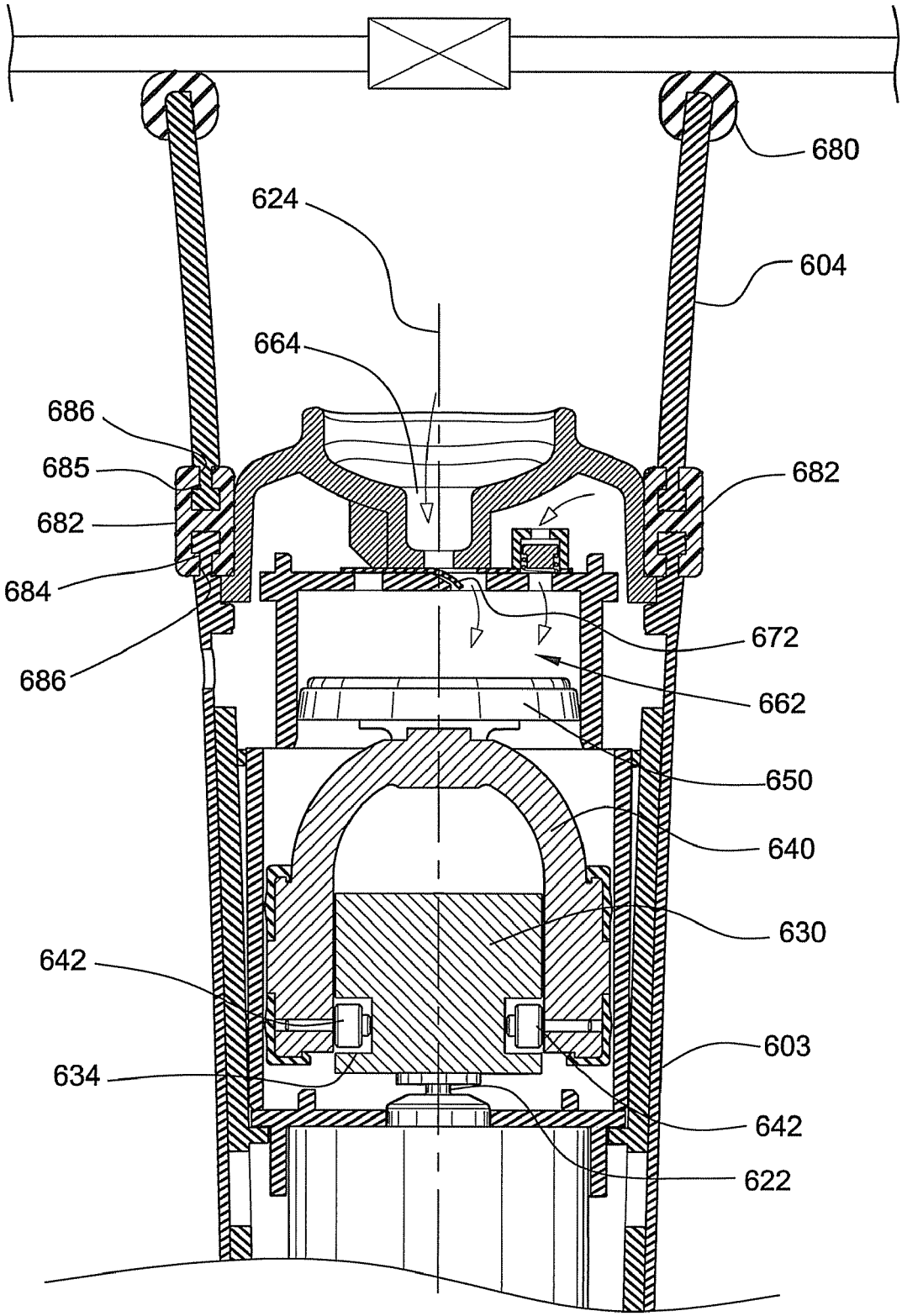
FIG. 12 is an elevational cross-sectional view showing the evacuation device of FIG. 10 engaging a container and conducting an intake stroke.
Figure 13:
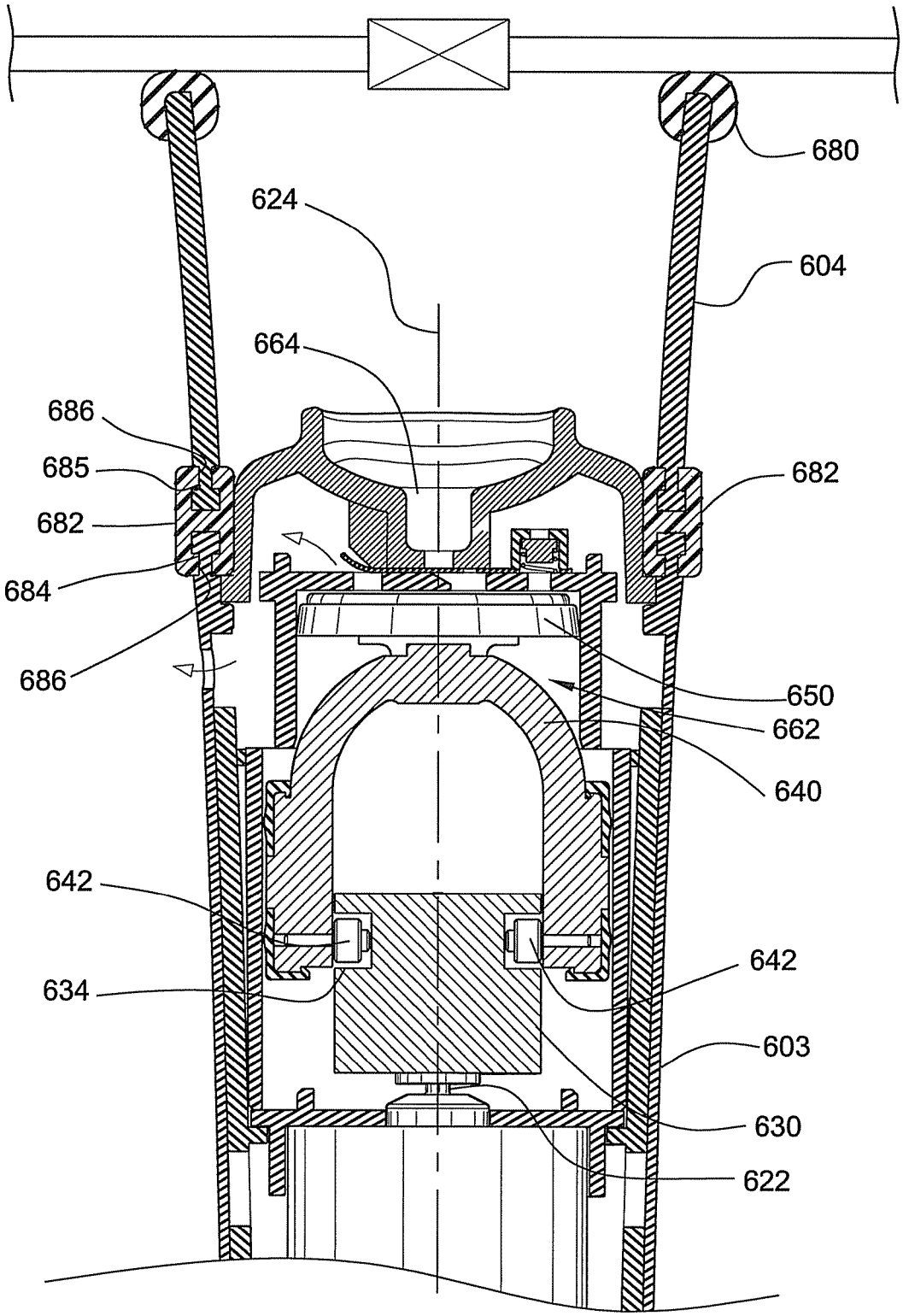
FIG. 13 is an elevational cross-sectional view showing the evacuation device of FIG. 10 engaging a container and conducting an exhaust stroke.

Referring to FIGS. 12 and 13, in operation, the motor shaft 622 rotates the cam 630 thus moving the channel 634 about in a circle. As the sinusoidinal channel 634 rotates, the follower elements 642 and the connected yoke 640 are reciprocally driven forward and backward along the axis line 624. The reciprocal driving of the yoke 640 results in reciprocal motion of the reciprocal element 650 within the chamber 662. When the reciprocal element 650 is moved rearward, as illustrated in FIG. 12, the inlet valve 672 opens allowing air within the skirt-like nozzle 604 to be drawn into the chamber 662. When the reciprocal element 650 is moved forward, as illustrated in FIG. 13, the inlet valve 672 closes and the drawn air is expelled from the chamber 662.

Referring to FIG. 11, to enhance the sealing interface between the evacuation device 600 and a storage bag, and to reduce noise during operation, a gasket 680 can be attached about the rim of the skirt-like nozzle 604. The gasket 680 can be made from any suitable material including, for example, a resilient foam, an elastomeric material, or rubber. Advantageously, these materials typically have a vibration dampening effect that can dissipate vibrations throughout the evacuation device resulting from operation of the airflow generating unit. As described above, when the gasket 680 is pressed against the sidewall of a storage bag, the gasket deforms to provide a leak-free interface. Also as described above, the vibration dampening effect of the resilient gasket can prevent chatter, rattling, or other noises from developing when the nozzle of an operating evacuation device is placed against the rigid bracket or countertop, i.e. the gasket acts like a cushion between the rigid nozzle and a rigid support surface.

In a further embodiment of the hand held evacuation device of FIG. 11, the main body portion 603 of the housing 602 and the nozzle 604 can be formed as separate distinct parts. To connect the two parts together, an intermediate gasket 682 can be provided between and connected to both the main body 603 and the nozzle 604. The intermediate gasket 682 can be formed as a tubular sleeve. Accordingly, the chamber 662 located in the main body 603 of the housing 602 can still communicate with the inlet opening 604 via the intermediate gasket 682. In the illustrated embodiment, to hold the intermediate gasket 682 in place, inner and outer notches 684, 685 can be formed in both the opposing ends of the main body 603 and the nozzle 604. The intermediate gasket 682 can then be molded about the pre-positioned notched ends 684, 685 of the main body 603 and the nozzle 604 or can be pre-molded with corresponding slots 686 on each end that allow for insertion of the notched ends in a snap-fit manner. To further improve securing of the intermediate gasket 682 to the main body 603 and nozzle 604, adhesive can be applied. Like the gasket about the rim, the intermediate gasket 682 can be made from any suitable material such as, for example, resilient foam, an elastomeric material, or rubber which preferably has a vibration dampening effect. The intermediate gasket 682 can thereby prevent transfer of vibrations resulting from rotation of the motor 620 and translation of the reciprocal element 650 by isolating those vibrations in the main body 603. Hence, noises resulting from chatter or rattling of the nozzle against a rigid support surface are reduced or prevented. In various embodiments, a gasket can be included on the rim only, between the nozzle and the main body only, or at both locations.

Figure 14:
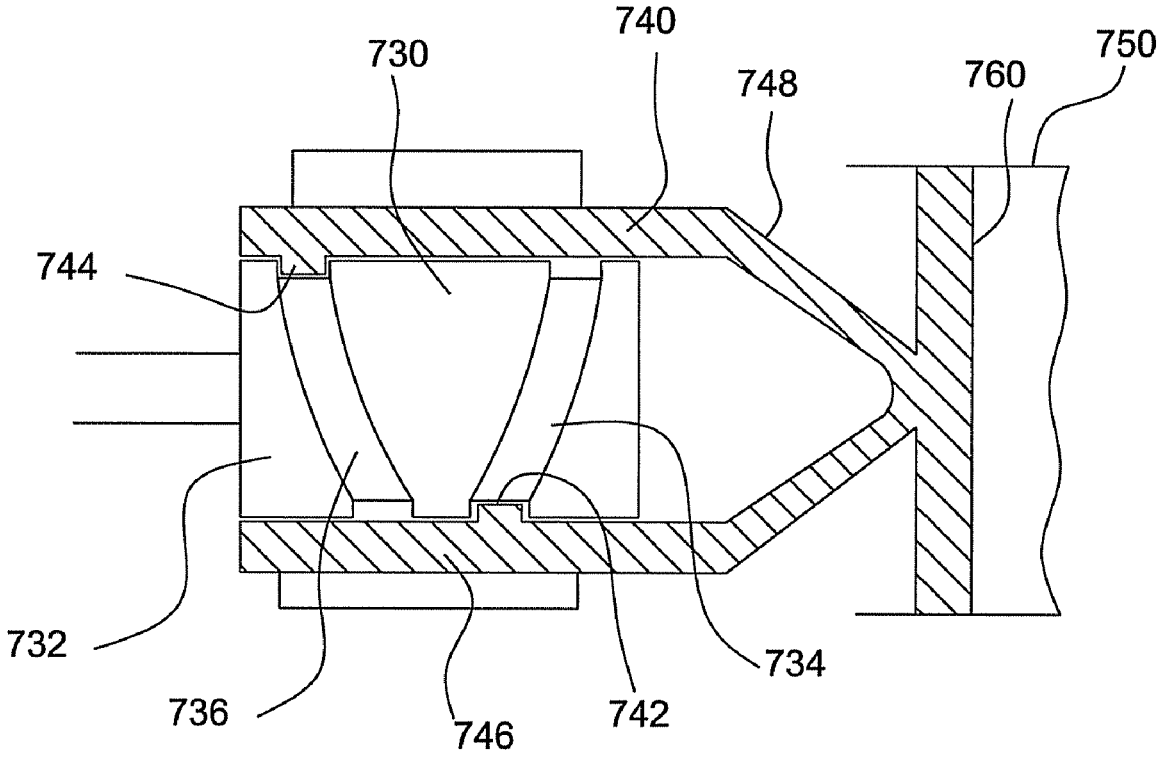
FIG. 14 is a schematic view of another embodiment of the cam and yoke for inclusion with the evacuation device of FIG. 11 wherein the cam is configured with two channels.

Referring to FIG. 14, there is illustrated schematically another embodiment of the cam 730 and yoke 740 components that can be used with the various embodiments of the evacuation device of FIGS. 11, 12, and 13. The cam 730 includes a first channel 734 and a second channel 736 that are disposed into the cylindrical sidewall 732. The first and second channels can be axially separated with the first channel 734 proximate the forward end of the cam 730 and the second channel 736 proximate the rearward end of the cam, with both channels having a sinusoidinal pattern. To engage the channels 734, 736, the yoke 740 has a first follower element 742 extending inwardly from the first leg 746 and a second follower element 744 extending inwardly from the second leg 748. The first and second follower elements 742, 744 are attached at different locations along the lengths of the respective first and second leg 746, 748 to correspond to the axially spaced first and second channels 734, 736. When the cam 730 rotates, it drives the yoke 740 and the reciprocal element 760 via the follower elements 742, 744 in a reciprocal manner with respect to the chamber 750.

Figure 15:
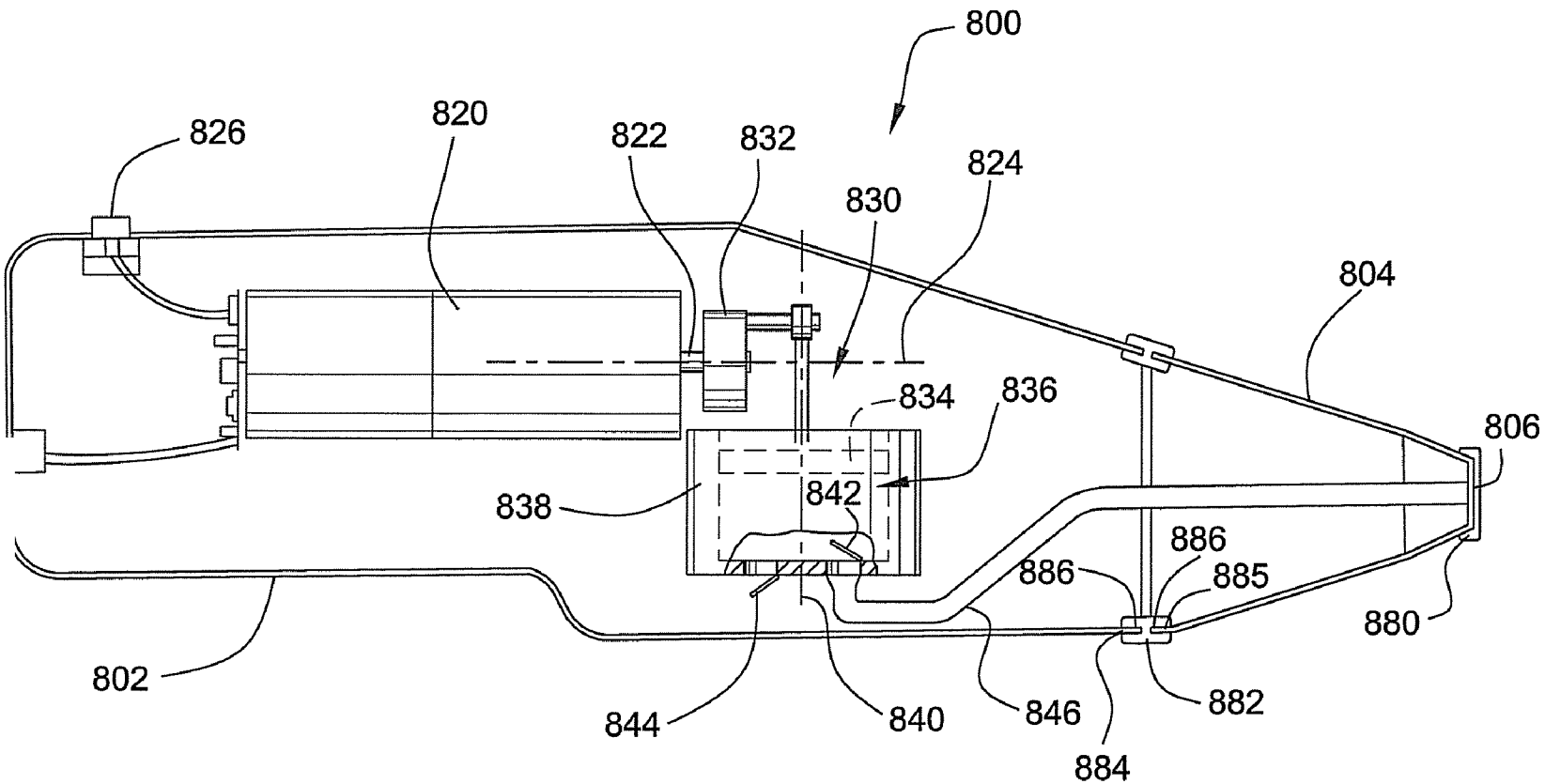
FIG. 15 is an elevational cross-sectional view of another embodiment of the hand-held evacuation device that includes an airflow generating unit having a crank wheel and a piston.

Referring to FIG. 15, there is illustrated another embodiment of a handheld evacuation device 800 for removing latent air from a storage bag. The evacuation device includes a comparatively rigid, elongated housing 802 adapted to be gripped by the hand of a user which at one end tapers to a nozzle 804 that provides an air inlet opening 806. Enclosed within the housing 802 is an electrical motor 820 with a rotatable shaft 822 extending along a first axis line 824. To activate the electrical motor 820, a switch 826 can be provided on the housing 802 and wired to the motor. The motor and shaft drive an airflow generating unit 830 which communicates with the nozzle 804 to draw air from the air inlet opening 806.

More specifically, the airflow generating unit 830 can include a circular eccentric wheel 832 that is concentrically mounted onto the motor shaft 822. The airflow generating unit 830 also includes a piston 834 slidably receivable in a chamber 836 delineated by a chamber housing 838. Moreover, the piston 834 is movable within the chamber 836 along a second axis line 840 which can be generally normal to the first axis line 824. To enable reciprocal motion of the piston 834 with respect to the chamber 836 along the second axis line 840, the piston is eccentrically connected to an eccentric wheel 832. Specifically, the piston 834 is connected to the eccentric wheel 832 at a position radially outward from the center of the eccentric wheel which is aligned with the first axis line 824. Hence, as the motor shaft 822 rotates, the eccentric connection causes the piston 834 to reciprocate within the chamber 836.

For enabling the reciprocal motion of the piston 834 to provide a pumping action for drawing air from the inlet opening 806, the chamber housing 838 can include an inlet valve 842 and an exhaust valve 844. The inlet valve 842 may be arranged between the chamber 836 and a conduit 846 from the air inlet opening 806. When the piston 834 is withdrawn with respect to the chamber housing 838, the inlet valve 842 opens and air from the inlet opening 806 is drawn into the chamber. When the piston 834 is moved inward of the chamber housing 838, the exhaust valve 844 opens while the inlet valve 842 simultaneously closes and air is expelled from the chamber 836.

To enhance the sealing interface between the evacuation device 800 and a storage bag, and to reduce noise during operation, in various embodiments a gasket 880 can be made from a suitable resilient or elastomeric material and can be attached about the rim of the inlet opening 806. Also, in various embodiments, the housing 802 can be formed in separate, distinct parts including the nozzle 804 and a main body 803 which are connected by a second gasket 882 placed intermediately therebetween. To hold the intermediate gasket 882 in place, the opposing ends 884, 885 of the main body 803 and nozzle 804 can be formed with a generally squared or blunted shape. The intermediate gasket 882 can then be formed with appropriately dimensioned slots 886 on each end that allow for the ends 884, 885 of the main body 803 and nozzle 804 to be press-fitted into the gasket. To further improve securing of the intermediate gasket 882 to the main body 803 and nozzle 804, adhesive can be applied.

Accordingly, when the nozzle 804 of the device 800 is pressed against the sidewall of a storage bag, the gasket 880 can deform to provide a leak-free interface. Additionally, the vibration dampening effect of the resilient gasket 880 can prevent chatter, rattling, or other noises from developing when the nozzle 804 of an operating evacuation device 800 is placed against a rigid bracket or countertop, i.e. the gasket acts like a cushion between the rigid nozzle and a rigid support surface. Likewise, the intermediate gasket 882 can prevent transfer of vibrations resulting from rotation of the motor 820 and motion of the airflow generating unit 830 by isolating those vibrations in the main body 803. Hence, noises resulting from chatter or rattling of the nozzle against a rigid support surface are reduced or prevented. In various embodiments, a gasket can be included on the rim only, between the nozzle and the main body only, or at both locations.

Figure 16:
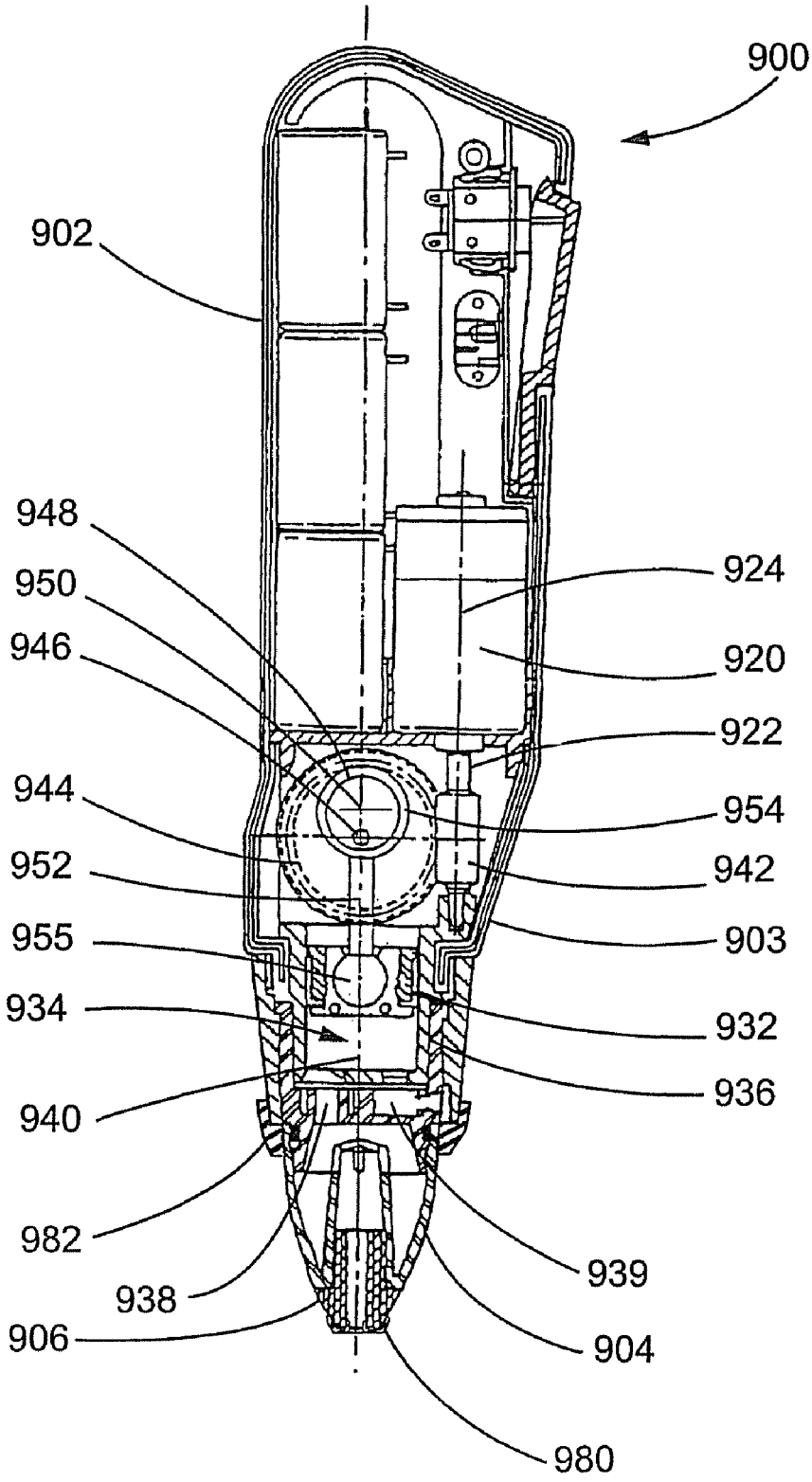
FIG. 16 is a front elevational cross-sectional view of another embodiment of the hand-held evacuation device that includes an airflow generating unit having pinion and crown gears.
Figure 17:
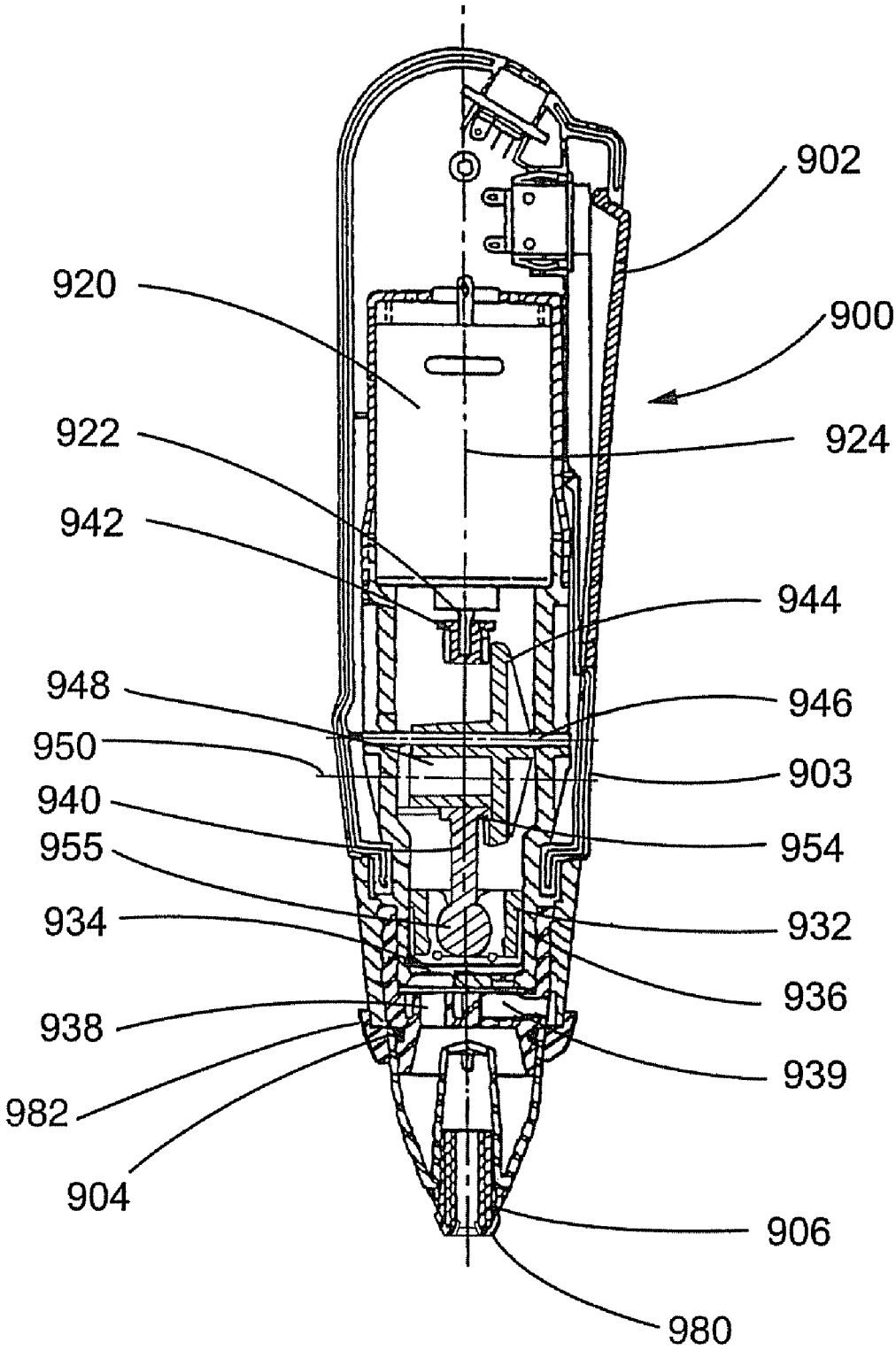
FIG. 17 is a side elevational cross-sectional view of the hand-held evacuation device of FIG. 16 showing the crown gear rotated to a different position.

Referring to FIGS. 16 and 17, there is illustrated another embodiment of a hand held evacuation device 900 that employs a particular gearing mechanism to drive the air flow generating unit. The evacuation device 900 includes an elongated housing 902, which is adapted to be gripped by the hands of a user, made from a suitably rigid material such as thermoplastic that tapers at one end to form a nozzle 904 that provides an inlet opening 906. Enclosed within the housing 902 is an electric motor 920 from which a rotating motor shaft 922 extends along a first axis line 924. The evacuation device 900 also includes an airflow generating unit 930 that in part converts the rotational motion of the motor 920 to linearly reciprocal motion that provides a pumping action.

The airflow generating unit 930 includes a piston 932 slideable along a second axis line 940 and received within a chamber 934 delineated by a chamber housing 936. The second or chamber axis line 940 can be generally parallel to the first axis line 924 of the motor. The chamber 934 can communicate with the inlet opening 906 via an inlet channel 938 and with the exterior of the housing 902 via an exhaust channel 939. To drive the piston 932 with respect to the chamber housing 936, the airflow generating unit 930 includes a pinion gear 942 that is mounted to the motor shaft 922. The pinion gear 942 in turn is engaged to a large diameter circular crown gear 944 that rotates about a third axis line 946 arranged normal to the first axis line 924. Provided within and engaged to the crown gear 944 is a smaller diameter eccentric member 948. The eccentric member 948 can be rotated by the crown gear 944 about its concentric axis 950, which is offset from the third axis 946 of the crown gear. An elongated connecting rod 952 is eccentrically connected at one end 954 to the eccentric member 948. A second end 955 of the connecting rod 952 can be spherically shaped and received in the piston 932 to form a ball-and-socket joint.

In operation, rotation of the pinion gear 942 about the first axis line 924 is converted to rotation of the crown gear 944 about the third axis line 946 which in turn rotates the eccentric member 948 about its own axis line 950. Because of the eccentric connection, rotation of the eccentric member 948 oscillates the connecting rod 952 in a manner that moves the piston 932 back and forth within the chamber 934 along the chamber axis line 940. Referring to FIG. 16, the piston 932 is withdrawn with respect to the chamber 934 as it would be if completing an intake stroke. Referring to FIG. 17, the piston 932 is extended into the chamber 934 as it would be if completing an exhaust stroke. As described above, the linearly reciprocal movement of the piston 932 with respect to the chamber 934 and the operation of the inlet and exhaust channels 938, 939 can provide suction at the inlet opening 906.

As described above with respect to some of the other illustrated embodiments of the evacuation devices, to enhance the sealing interface between the present evacuation device 900 and a storage bag, and to reduce noise during operation, in various embodiments a gasket 980 can be attached about the rim of the inlet opening 906. The gasket can be made from a resilient foam, an elastomeric material or rubber. Also, in various embodiments, the housing 902 can be separated into the distinct parts of the nozzle 904 and a main body 903 which are connected by a second gasket 982 placed intermediately therebetween. The gasket can be made from a resilient foam, an elastomeric material or rubber. Accordingly, when the nozzle 904 of the device 900 is pressed against a sidewall of a storage bag, the gasket 980 about the inlet opening 906 can deform to provide a leak-free interface. Additionally, the vibration dampening effect of the resilient gasket 980 can prevent chatter, rattling, or other noises from developing when the nozzle 904 of an operating evacuation device 900 is placed against the rigid bracket or countertop, i.e. the gasket acts like a cushion between the rigid nozzle and a rigid support surface. Likewise, the intermediate gasket 982 can prevent transfer of vibrations resulting from rotation of the motor 920 and motion of the airflow generating unit 930 by isolating those vibrations in the main body 903. Hence, noises resulting from chatter or rattling of the nozzle against a rigid support surface are reduced or prevented. In various embodiments, a gasket can be included on the rim only, between the nozzle and the main body only, or at both locations.

Figure 18:
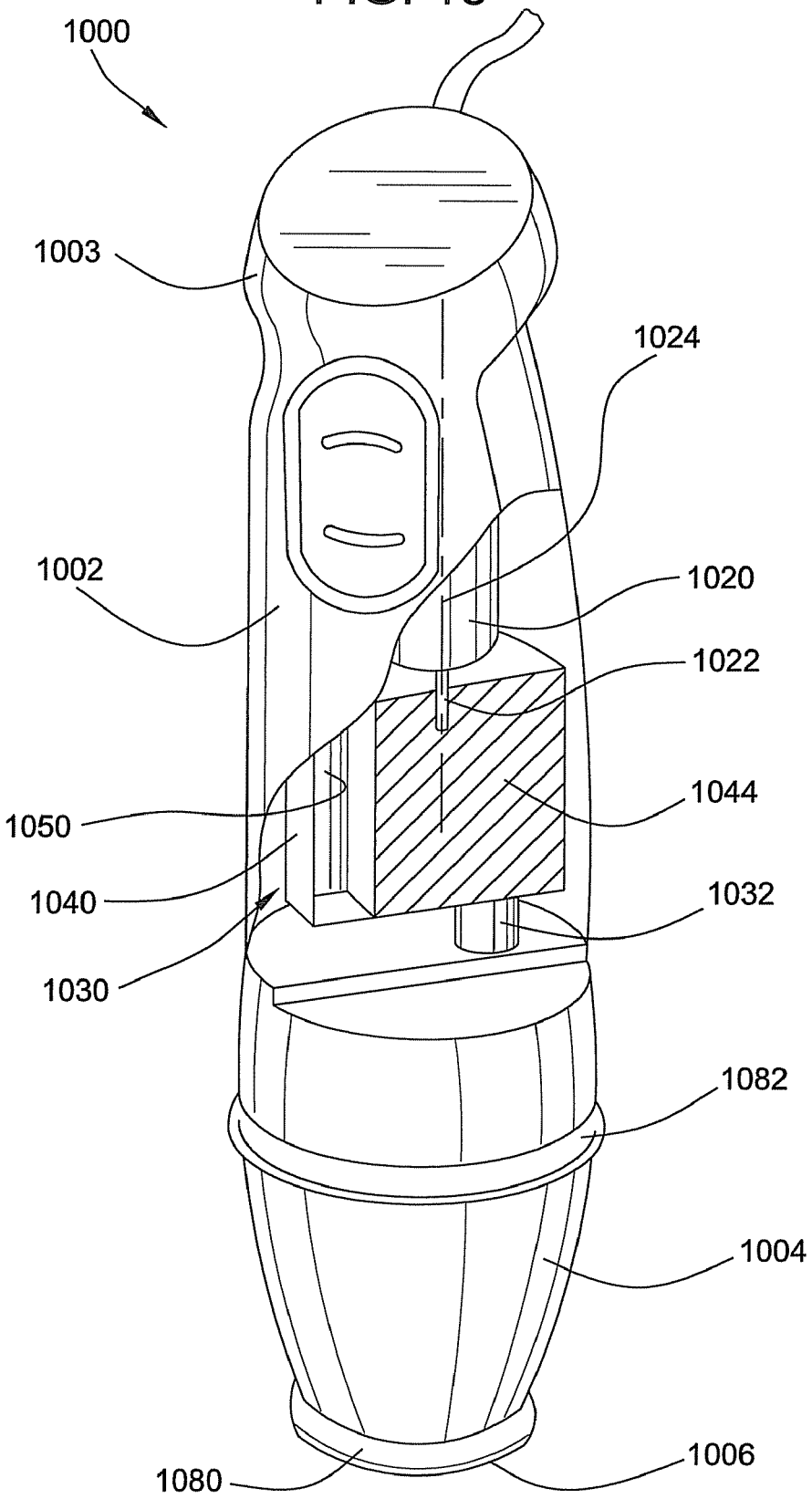
FIG. 18 is a cutaway perspective view of another embodiment of a handheld evacuation device that includes an airflow generating unit having a rotary vane pumping mechanism.

Illustrated in FIG. 18 is another embodiment of a handheld evacuation device 1000 for evacuating air from a storage bag that employs a rotary vane pumping mechanism as part of the airflow generating unit. The evacuation device 1000 includes an elongated housing 1002 that can be made of a rigid thermoplastic and is adapted to be gripped by the hands of a user. The housing 1002 tapers at one end to form a nozzle 1004 which provides an inlet opening 1006. Enclosed within the housing is an electric motor 1020 with a rotating shaft 1022 that extends along a first axis line 1024. To provide suction at the inlet opening 1006 using the rotational motion of the motor 1020, the airflow generating unit 1030 including the rotary vane pumping mechanism is enclosed within the housing 1002 and communicates with the inlet opening via a suction pipe 1032.

Figure 19:
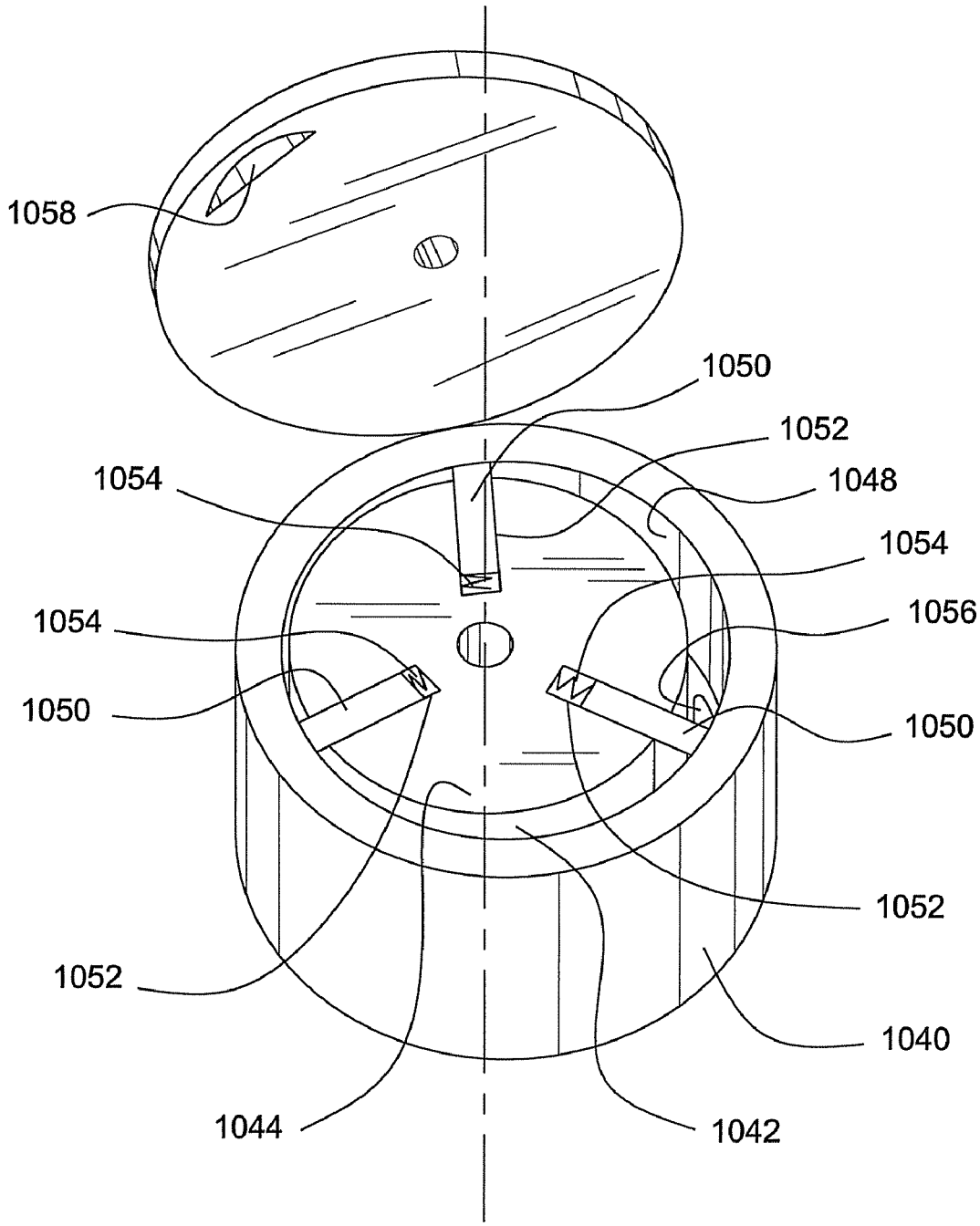
FIG. 19 is a top perspective view of the rotary vane pumping unit.

Referring to FIG. 19, the rotary vane pumping unit includes a hollow, cylindrical stator 1040 that provides an internal chamber 1042. Received within the chamber 1042 is a rotatable, cylindrical rotor 1044 which can be concentrically mounted to the motor shaft. The rotational axis line 1024 of rotor 1044, which corresponds to the axis line of the motor shaft, is offset within the stator 1040 such that one segment of the rotor is adjacent and in sliding contact with the inner wall of the stator. The offset rotor 1044 and stator 1040 thereby provide a crescent-shaped void 1048.

The rotary vane pumping mechanism also includes a plurality of displaceable vanes 1050 that are arranged to sweep through the crescent-shaped void 1048. To accommodate and drive the vanes, the rotor includes a plurality of radially arranged slots 1052, the width of each slot generally corresponding to the width of a vane 1050. Accordingly, each vane can be slidingly accommodated in a slot 1052. Additionally, arranged in each slot 1052 are one or more springs 1054 that urge the vanes 1050 radially outward of the slots so that the tips of the vanes contact a portion of the inner wall of the stator 1040. To enable air to move in and out of the rotary vane pumping mechanism, an inlet aperture 1056 and an exhaust aperture 1058, each located at different angular positions, can communicate with the crescent void 1048.

In operation, the rotor 1044 rotates clockwise with respect to the stator 1040 so that the vanes 1050 sweep through the crescent void 1048 from the inlet aperture 1056 to the exhaust aperture 1058. As will be appreciated from FIG. 19, the sweeping motion of the vanes 1050 initially creates an expanding volume in the region of the inlet aperture 1056 that draws air into the crescent void 1048. Subsequently, the continued sweeping motion of the vanes 1050 in the region of the exhaust aperture 1058 creates a collapsing volume that causes air to discharge from the crescent void 1048. This ongoing action thereby continuously moves air from the inlet aperture to the exhaust aperture thus providing the suction force. One potential advantage of rotary vane pumping mechanisms is that they typically are less susceptible to abrupt pressure fluctuations that may be common with other pumping mechanisms.

Referring to FIG. 18, to enhance the sealing interface between the present evacuation device 1000 and a storage bag, and to reduce noise during operation, in various embodiments a gasket 1080 can be attached about the rim of the inlet opening 1006. The gasket can be made from a resilient foam, an elastomeric material or rubber. Also, in various embodiments, the housing 1002 can be separated into the distinct parts of the nozzle 1004 and a main body 1003 which are connected by a second gasket 1082 placed intermediately therebetween. The intermediate gasket can be produced from a tubular sleeve. The gasket can be made from a resilient foam, an elastomeric material or rubber. As described above, when the nozzle 1004 of the device 1000 is pressed against a sidewall of a storage bag, the gasket 1080 about the inlet opening 1006 can deform to provide a leak-free interface. Furthermore, the vibration dampening effect of the resilient gasket 1080 can prevent chatter, rattling, or other noises from developing when the nozzle 1004 of an operating evacuation device 1000 is placed against the rigid bracket or countertop, i.e. the gasket acts like a cushion between the rigid nozzle and a rigid support surface. Additionally, in particular embodiments, the intermediate gasket 1082 can prevent transfer of vibrations resulting from rotation of the motor 1020 and motion of the airflow generating unit 1030 by isolating those vibrations in the main body 1003. Hence, noises resulting from chatter or rattling of the nozzle against a rigid support surface are reduced or prevented. In various embodiments, a gasket can be included on the rim only, between the nozzle and the main body only, or at both locations.

In some embodiments, the air which is exhausted from the airflow generating unit exits within the housing and does not exit directly from the housing. The exhaust air exits the housing through other openings in the housing, such as, the seams of the housing, the switch opening, mating areas, cord opening or any gap not intended as an exhaust port. By exhausting the air within the housing, the noise of the evacuation device may be reduced. The feature of exhausting the air within the housing may be used with any of the embodiments noted herein.

Referring to FIGS. 20, 21, and 22, the one-way valve element 1100 for use with a storage bag of the foregoing type can include a rigid valve body 1110 that cooperates with a movable disk 1112 to open and close the valve element. The valve body 1110 includes a circular flange portion 1114 extending between parallel first and second flange faces 1120, 1122. Concentric to the flange portion 1114 and projecting from the second flange face 1122 is a circular boss portion 1118 which terminates in a planar boss face 1124 that is parallel to the first and second flange faces. The circular boss portion 1118 is smaller in diameter than the flange portion 1114 so that the outermost annular rim of the second flange face 1122 remains exposed. The valve body 1110 can be made from any suitable material such as a moldable thermoplastic material like nylon, HDPE, high impact polystyrene (HIPS), polycarbonates (PC), and the like.

Disposed concentrically into the valve body 1110 is a counter-bore 1128. The counter-bore 1128 extends from the first flange face 1120 part way towards the boss face 1124. The counter-bore 1128 defines a cylindrical bore wall 1130. Because it extends only part way toward the boss face 1124, the counter-bore 1128 forms within the valve body 1110 a preferably planar valve seat 1132. To establish fluid communication across the valve body 1110, there is disposed through the valve seat 1132 at least one aperture 1134. In fact, in the illustrated embodiment, a plurality of apertures 1134 are arranged concentrically and spaced inwardly from the cylindrical bore wall 1130.

To cooperatively accommodate the movable disk 1112, the disk is inserted into the counter-bore 1128. Accordingly, the disk 1112 is preferably smaller in diameter than the counter-bore 1128 and has a thickness as measured between a first disk face 1140 and a second disk face 1142 that is substantially less than the length of the counter-bore 1128 between the first flange face 1120 and the valve seat 1132. To retain the disk 1112 within the counter-bore 1130, there is formed proximate to the first flange face 1120 a plurality of radially inward extending fingers 1144. The disk 1112 can be made from any suitable material such, as for example, a resilient elastomer.

Referring to FIG. 22, when the disk 1112 within the counter-bore 1130 is moved adjacent to the fingers 1144, the valve element 1100 is in its open configuration allowing air to communicate between the first flange face 1120 and the boss face 1124. However, when the disk 1112 is adjacent the valve seat 1132 thereby covering the apertures 1134, the valve element 1100 is in its closed configuration. To assist in sealing the disk 1112 over the apertures 1134, a sealing liquid can be applied to the valve seat 1132. Furthermore, a foam or other resilient member may be placed in the counter-bore 1128 to provide a tight fit of the disk 1112 and the valve seat 1132 in the closed position.

To attach the valve element 1100 to the first sidewall, referring to FIG. 21, an adhesive can be applied to the exposed annular rim portion of the second flange face 1122. The valve element 1100 can then be placed adjacent the exterior surface of the first sidewall with the boss portion 1118 being received through the hole disposed into the sidewall and thereby pass into the internal volume. Of course, in other embodiments, adhesive can be placed on other portions of the valve element, such as the first flange face, prior to attachment to the sidewall.

In other embodiments, the one-way valve element can have a different construction. For example, the one-way valve element can be constructed from flexible film materials similar to those disclosed in U.S. Pat. No. 2,927,722, U.S. Pat. No. 2,946,502, and U.S. Pat. No. 2,821,338, all incorporated by reference in their entirety.

Figure 23:
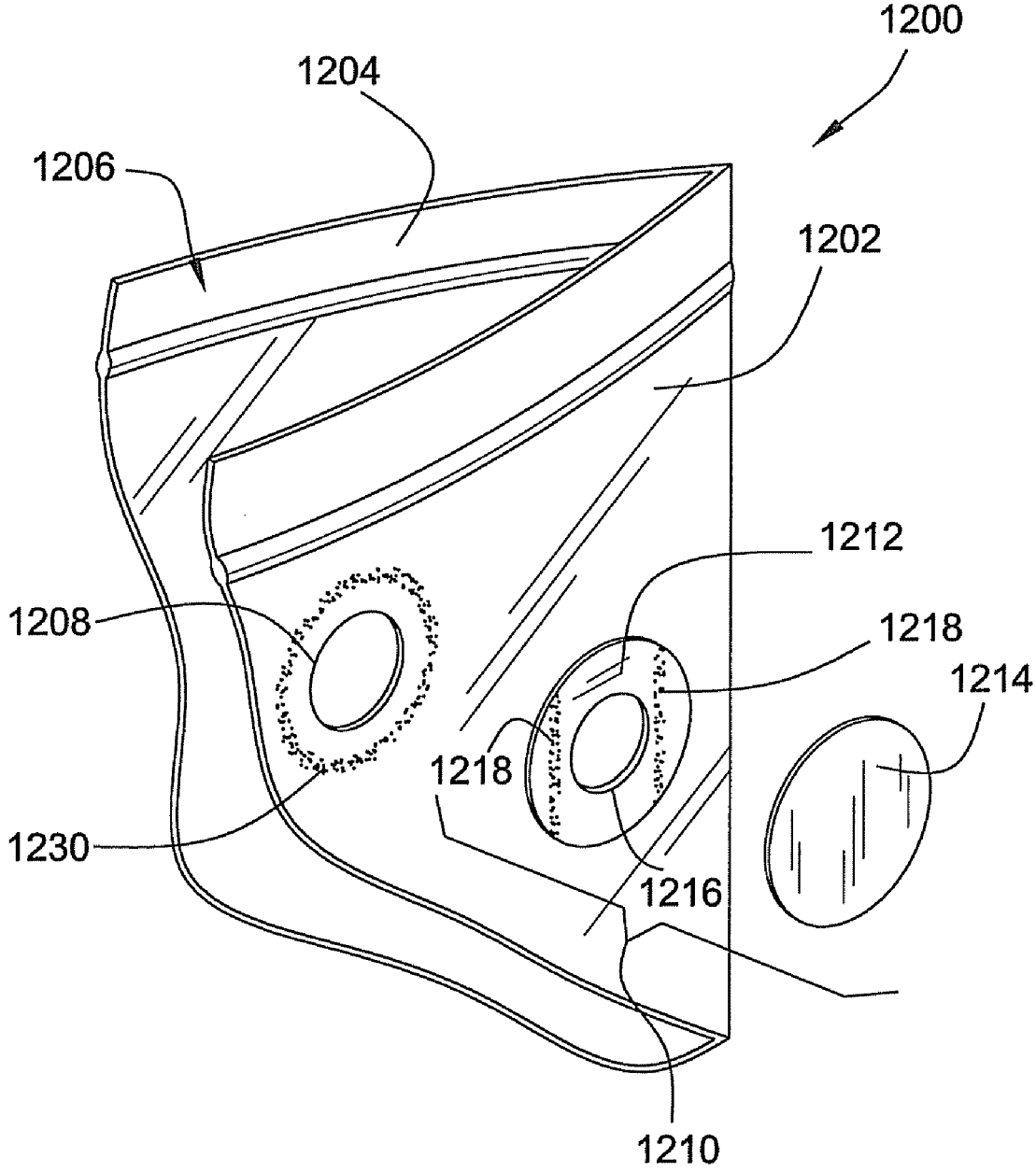
FIG. 23 is an exploded view of another embodiment of the one-way valve element for attachment to the flexible bag.

As illustrated in FIG. 23, such a flexible one-way valve element 1210 made in accordance with this style can include a flexible, circular base layer 1212 that cooperates with a correspondingly circular shaped, resilient top layer 1214 to open and close the valve element. The top and bottom layers can be made from any suitable material such as, for example, a flexible thermoplastic film. Disposed through the center of the base layer 1212 is an aperture 1216, thus providing the base layer with an annular shape. The top layer 1214 is placed over and adhered to the base layer 1212 by two parallel strips of adhesive 1218 that extend along either side of the aperture 1216, thereby covering the aperture with the top layer and forming a channel. The base layer 1212 is then adhered by a ring of adhesive 1220 to the flexible bag 1200 so as to cover the hole 1208 disposed through the first sidewall 1202.

When the sidewalls 1202, 1204 of the bag 1200 are compressed together, such as by using an evacuation device, air from the internal volume 1206 will pass through the hole 1208 and the aperture 1216 thereby partially displacing the top layer 1214 from the base layer 1212. The air can then pass along the channel formed between the adhesive strips 1218 and escape to the environment. After the evacuation of air from the internal volume, the resilient top layer 1214 will return to its prior configuration covering and sealing the aperture 1216. The valve element 1210 may also contain a viscous material such as an oil, grease, or lubricant between the two layers in order to prevent air from reentering the bag. In an embodiment, base layer 1212 may also be a rigid sheet material.

Figure 24:
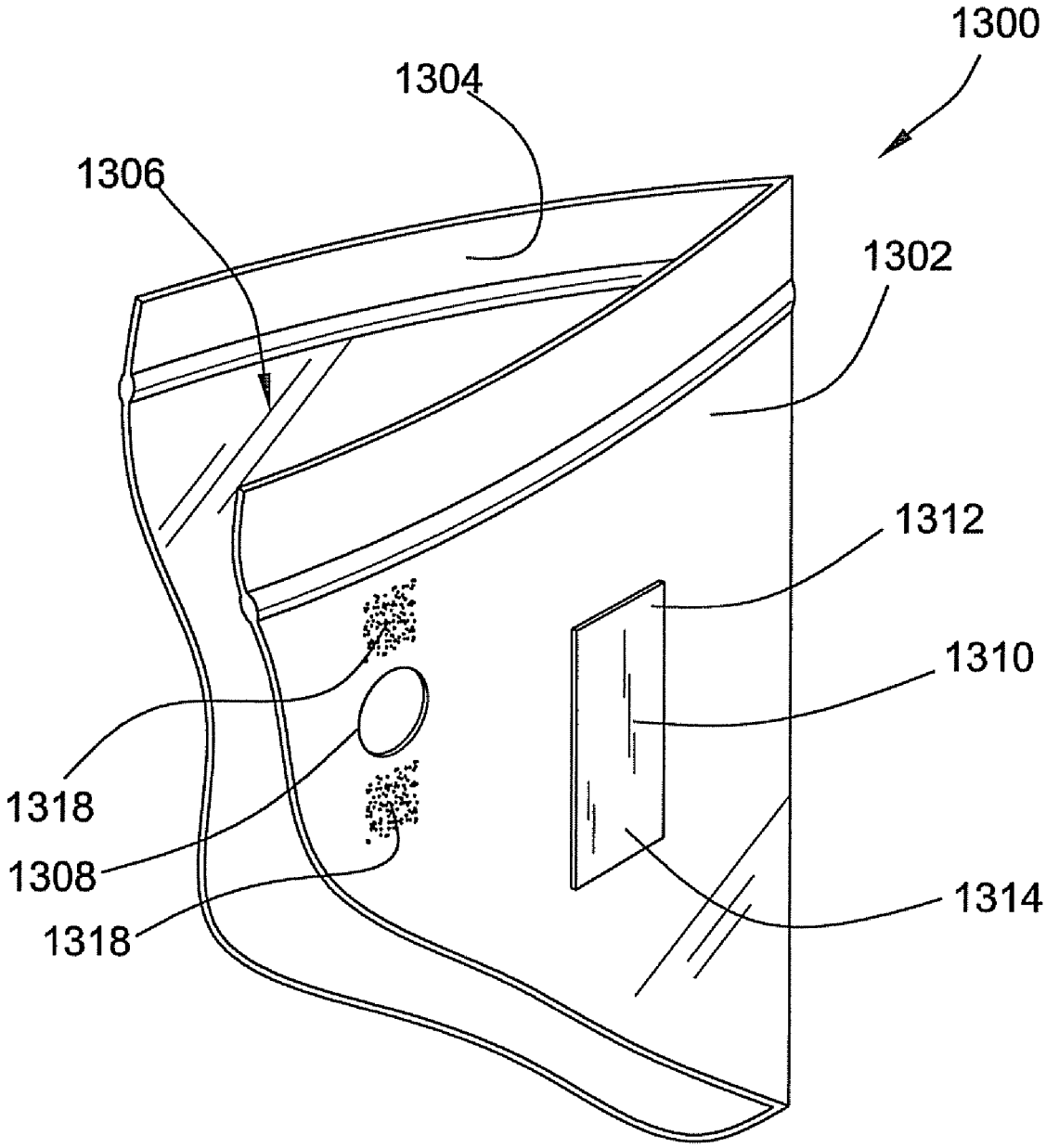
FIG. 24 is an exploded view of another embodiment of the one-way valve element for attachment to the flexible bag.

Illustrated in FIG. 24 is another embodiment of the valve element 1310 that can be attached to the flexible plastic bag 1300. The valve element 1310 is a rectangular piece of flexible thermoplastic film that includes a first end 1312 and a second end 1314. The valve element 1310 is attached to the first sidewall 1302 so as to cover and seal a hole 1308 disposed through the first sidewall. The valve element 1310 can be attached to the sidewall 1302 by patches of adhesive 1318 placed on either side of the hole 1308 so as to correspond to the first and second ends 1312, 1314. When the sidewalls 1302, 1304 of the flexible bag 1300 are collapsed together, air from the internal volume 1306 displaces the flexible valve element 1310 so as to unseal the hole 1308. After evacuation of air from the internal volume 1306, the valve element 1320 will again cover and seal the hole 1308.

Figure 25:
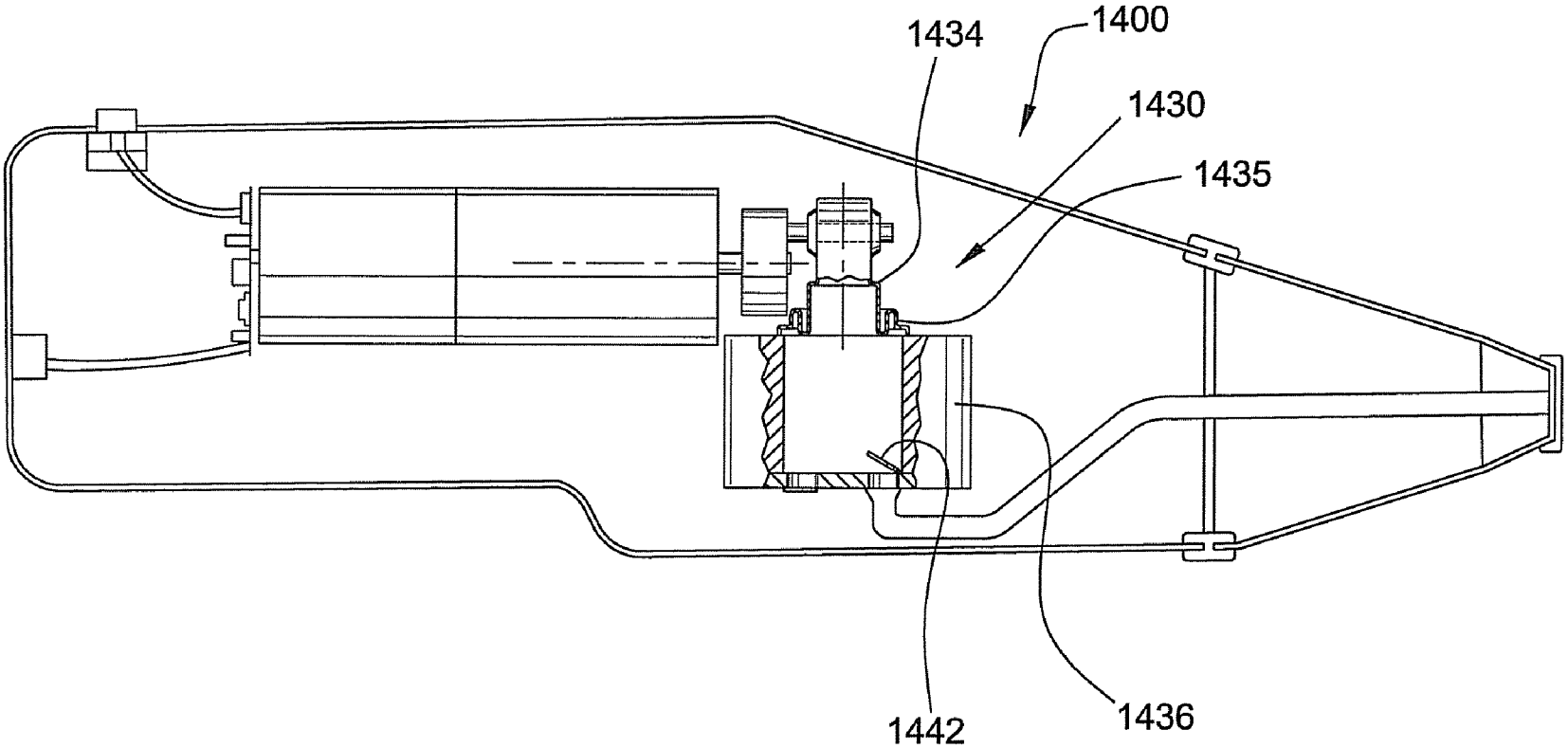
FIG. 25 is a cross-sectional view of another embodiment of an evacuation device using a diaphragm and conducting an intake stroke.
Figure 26:
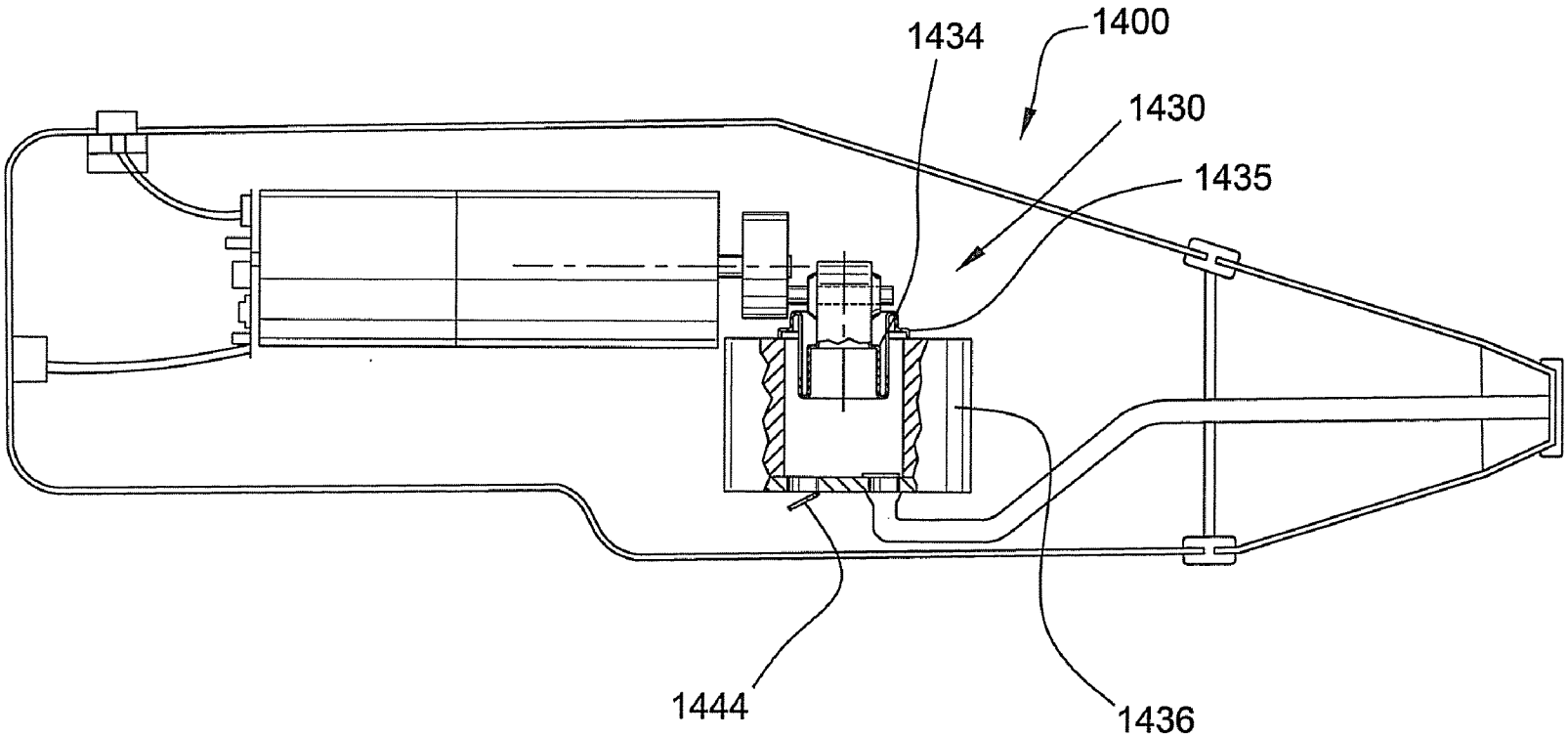
FIG. 26 is a cross-sectional view of the evacuation device in FIG. 25 and conducting an exhaust stroke.

Referring to FIGS. 25 and 26, there is illustrated another embodiment of a handheld evacuation device 1400 for removing latent air from a storage bag. The evacuation device 1400 is similar to the evacuation device 800 shown in FIG. 15 except that the device 1400 uses an air flow generating unit 1430 which includes a diaphragm pump. The diaphragm pump may include a diaphragm 1435. The diaphragm 1435 may be attached to the piston 1434 and the chamber 1436. The diaphragm 1435 maintains an airtight seal between the piston and the chamber. In addition, the diaphragm is flexible and may include folds which allow the diaphragm to move with the piston without rupturing the diaphragm. Referring to FIG. 25, the device is conducting the intake stroke. The piston 1434 is in an upward position and the inlet valve 1442 is open. Referring to FIG. 26, the device is conducting the exhaust stroke. The piston 1434 is in a downward position and the exhaust valve 1444 is open. The diaphragm may be used with any of the embodiments discussed herein as appropriate.

As will be appreciated by those of skill in the art, other embodiments of one-way valve elements can be used with the flexible plastic bag such as, for example, an elastomer slit valve, duckbill valve or check valve.

Hence, the devices and methods improve the evacuation of a storage bag having a one-way valve element attached thereto.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventor(s) for carrying out the invention. Variations of those preferred embodiments may become apparent to those of ordinary skill in the art upon reading the foregoing description. The inventor(s) expect skilled artisans to employ such variations as appropriate, and the inventor(s) intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. An evacuation device comprising:

a housing having an exterior and an interior and adapted to be gripped by a user, the housing including a main body and nozzle providing a rim having an inlet opening, the nozzle having a rim gasket attached about the rim and the nozzle connected to the main body by an intermediate gasket made of elastomeric material and having a pair of interior notched ends on the housing interior and a pair of exterior notched ends on the housing exterior, wherein the intermediate gasket is secured to the main body and the nozzle by adhesive;

the main body having a valve plate, an inlet aperture, an outlet aperture, and an air flow generating unit; the air flow generating unit communicating with the inlet aperture via an inlet valve in the valve plate and communicating with the outlet aperture via an outlet valve in the valve plate; wherein the airflow generating unit includes a motor with a rotating shaft extending along an axis line;

a cam having a cylindrical sidewall and a channel disposed into the sidewall, the cam mounted to the motor shaft;

a yoke having a follower element received in the channel; and a reciprocal element connected to the yoke, the reciprocal element movable along the axis line within a chamber.

2. The evacuation device of claim 1, wherein the yoke includes a first arm and a second arm, the cam located between the first and second arms.

3. The evacuation device of claim 1, wherein the reciprocal element is a piston slidably received within the chamber.

4. An evacuation device comprising:

a housing having an interior and an exterior and adapted to be gripped by a user, the housing including a main body and nozzle providing a rim having an inlet opening, the nozzle having a rim gasket attached about the rim and the nozzle connected to the main body by an intermediate gasket fitting between the nozzle and the main body and having a pair of interior notched ends on the housing interior and a pair of exterior notched ends on the housing exterior, wherein the notched ends connect with corresponding interior and exterior slots on the nozzle and the main body;

the main body having a valve plate, an inlet aperture, an outlet aperture, and an air flow generating unit; the air flow generating unit communicating with the inlet aperture via an inlet valve in the valve plate and communicating with the outlet aperture via an outlet valve in the valve plate;

wherein the airflow generating unit includes motor having a rotating shaft and a rotary vane pump.

5. The evacuation device of claim 4, wherein the rotary vane pump includes a rotator mounted to the rotating shaft and a stationary stator, the rotator including a plurality of slots each accommodating a sliding vane.

6. An evacuation device comprising:

a housing having an interior and an exterior and adapted to be gripped by a user, the housing including a main body and nozzle providing a rim having an inlet opening, the nozzle having a rim gasket attached about the rim and the nozzle connected to the main body by an intermediate gasket fitting between the nozzle and the main body and having a pair of interior notched ends on the housing interior and a pair of exterior notched ends on the housing exterior, wherein the notched ends connect with corresponding interior and exterior slots on the nozzle and the main body;

the main body having a valve plate, an inlet aperture, an outlet aperture, and an air flow generating unit; the air flow generating unit communicating with the inlet aperture via an inlet valve in the valve plate and communicating with the outlet aperture via an outlet valve in the valve plate.

* * * * *